US006988384B2

(12) United States Patent
Okamoto

(10) Patent No.: US 6,988,384 B2
(45) Date of Patent: Jan. 24, 2006

(54) KNITTING METHOD USING FLAT KNITTING MACHINE AND KNITTING PROGRAM

(75) Inventor: Kazuyoshi Okamoto, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 101 days.

(21) Appl. No.: 10/476,013

(22) PCT Filed: Apr. 30, 2002

(86) PCT No.: PCT/JP02/04348

§ 371 (c)(1),
(2), (4) Date: Oct. 27, 2003

(87) PCT Pub. No.: WO02/092895

PCT Pub. Date: Nov. 21, 2002

(65) Prior Publication Data

US 2004/0154338 A1 Aug. 12, 2004

(30) Foreign Application Priority Data

May 11, 2001 (JP) ..... 2001-140987

(51) Int. Cl.
*D04B 7/04* (2006.01)

(52) U.S. Cl. ..... 66/64

(58) Field of Classification Search ..... 66/64, 66/69, 70, 76, 169 R, 170, 171, 172 R, 176
See application file for complete search history.

(56) References Cited

U.S. PATENT DOCUMENTS 5,417,088 A 5/1995 Nakai
5,584,197 A * 12/1996 Okuno ..... 66/64
5,826,445 A 10/1998 Okamoto
5,956,975 A 9/1999 Kawashima
6,550,284 B2 * 4/2003 Okamoto ..... 66/69
6,658,899 B2 * 12/2003 Okamoto ..... 66/64
6,668,593 B2 * 12/2003 Okamoto ..... 66/64
6,672,113 B2 * 1/2004 Okamoto ..... 66/76
6,766,666 B2 * 7/2004 Okamoto ..... 66/64
6,786,066 B2 * 9/2004 Okamoto ..... 66/172 R
6,796,149 B2 * 9/2004 Okamoto et al. ..... 66/64

FOREIGN PATENT DOCUMENTS

WO WO 01/63030 A1 8/2001
WO WO 01/64987 A1 9/2001

* cited by examiner

*Primary Examiner*—Danny Worrell
(74) *Attorney, Agent, or Firm*—Rothwell, Figg, Ernst & Manbeck, P.C.

(57) ABSTRACT

In knitting a neck hole, a left front body is knitted on a front needle bed while making widening stitches, and stitches of the neck hole and a right front body both being in halt are transferred onto a back needle bed, and with widening stitch, the back needle bed is racked in a direction moving away from the left front body. After knitting the neck hole of the left front body, the left front body and the neck hole are transferred onto the back needle bed, and the right front body is transferred back to the front needle bed, and the right front body is knitted while making widening stitches. With the widening stitch of the right front body, the back needle bed is racked in a direction moving away from the right front body.

In knitting the neck hole (12), wales extending from a take down roller to the knitting point are brought close to the perpendicular direction so that an appropriate take down force is applied to the stitches being knitted. As a result, a deep neck hole can be knitted under good knitting conditions.

10 Claims, 17 Drawing Sheets

FIG. 4

```
  ABCDEFGHIJKLMNOPQRSTUVWXYZabcdef
  ····↓↓↓↓↓↓↓↓↓↓↓↓↓↓↓↓↓↓↓↓↓↓↓↓·····
7     OOOOOOO□□□
```

FIG. 5

```
   ABCDEFGHIJKLMNOPQRSTUVWXYZabcdef
   ................................
15 OOOOOO^^^^□□□□□□□□□□□□□□^^^^OOOOOO 0P HALT
   ABCDEFGHIJKLMNOPQRSTUVWXYZabcdef

       ABCDEFGHIJKLMNOPQRSTUVWXYZabcdef
       ..↓↓↓↓↓↓↓↓↓↓↓↓↓↓↓↓↓↓↓↓↓↓↓↓↓↓↓↓↓↓....
14 OOOOOO^^^^□□□□□□□□□□□□□□^^^^OOOOOO R4P
   ABCDEFGHIJKLMNOPQRSTUVWXYZabcdef TRANSFER↓

       ABCDEFGHIJKLMNOPQRSTUVWXYZabcdef
       ..^^^^□□□□□□□□□□□□□□^^^^OOOOOO....
13 OOOOOO.......................... R4P KNIT
   ABCDEFGHIJKLMNOPQRSTUVWXYZabcdef

       ABCDEFGHIJKLMNOPQRSTUVWXYZabcdef
     ...^^^□□□□□□□□□□□□□□^^^^OOOOOO....
12 OOOOOO.......................... R3P KNIT
   ABCDEFGHIJKLMNOPQRSTUVWXYZabcdef

     ABCDEFGHIJKLMNOPQRSTUVWXYZabcdef
     ....^^□□□□□□□□□□□□□□^^^^OOOOOO....
11 OOOOOO.......................... R2P KNIT
   ABCDEFGHIJKLMNOPQRSTUVWXYZabcdef

    ABCDEFGHIJKLMNOPQRSTUVWXYZabcdef
    .....^□□□□□□□□□□□□□□^^^^OOOOOO....
10 OOOOOO.......................... R1P KNIT
    ABCDEFGHIJKLMNOPQRSTUVWXYZabcdef

   ABCDEFGHIJKLMNOPQRSTUVWXYZabcdef
   ......□□□□□□□□□□□□□□^^^^OOOOOO....
 9 OOOOOO↑↑↑↑↑↑↑↑↑↑↑↑↑↑↑↑↑↑↑↑↑↑↑↑↑↑.... 0P TRANSFER↑
   ABCDEFGHIJKLMNOPQRSTUVWXYZabcdef

   ABCDEFGHIJKLMNOPQRSTUVWXYZabcdef
   ................................
 8 OOOOOO□□□□□□□□□□□□□□^^^^OOOOOO.... 0P HALT
   ABCDEFGHIJKLMNOPQRSTUVWXYZabcdef
```

KNITTING METHOD USING FLAT KNITTING MACHINE AND KNITTING PROGRAM

CROSS REFERENCE TO RELATED APPLICATION

This application is a 35 USC §371 National Phase Entry Application from PCT/JP02/04348, filed Apr. 30, 2002, and designating the U.S.

FIELD OF THE INVENTION

The invention relates to knitting of knit garment with flat knitting machine, in particular, knitting of neck hole. The present invention also relates to knitting program for executing the above-mentioned knitting.

PRIOR ART

In knitting a neck hole in a front body, the applicant proposed followings: the front body is divided into a portion to the left and a portion to the right of the neck hole; for example, the left front body is knitted at first; at the time the stitches of the neck hole part and the stitches of the right front body are fixed on a needle bed; and the left front body being knitted is moved in a direction moving away from the neck hole as knitting proceeds (Japanese Patent 2538421). In this case, in knitting the right front body, the stitches of the neck hole part and the stitches of the left front body are fixed on a needle bed, and the right front body being knitted is moved in a direction of moving away from the neck hole. Apart from this, the present applicant developed a method of knitting a sleeved garment substantially seamlessly, and in particular, proposed a knitting method for connecting stitches of sleeves to stitches of a body (for example, Japanese Patent 3010483). After that, however, the present applicant found that if a front body (left front body or right front body) being knitted is moved in a direction of moving away from the neck hole, the knitting conditions will be deteriorated.

DISCLOSURE OF THE INVENTION

The primary object of the present invention is to ensure that at the time of knitting front bodies on the left and right of the neck hole a take down force be applied properly to the stitches so that a deep neck hole can be knitted under good knitting conditions (claims 1 through 10).

Secondary objects of the invention as claimed in claims 2, 4, 7 and 9 are to provide specific methods for that purpose.

Secondary objects of the invention as claimed in claims 3 through 5 and claims 8 through 10 are to connect a pair of tubular bodies such as left and right sleeves to the body concurrently with the formation of the neck hole.

Secondary objects of the invention as claimed in claims 5 and 10 are to provide specific methods for connecting a tubular body such as a sleeve to the body concurrently with the formation of the neck hole.

According to a knitting method of the invention, the knitting method on a flat knitting machine for knitting a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, comprises:

a) a step for knitting a front body comprising a right front body and left front body up to a point at which a neck hole is to be formed, then, knitting one of the right front body and the left front body, with substantially fixing on at least one of the needle beds with respect to the left-right direction, with sequentially forming widening stitches on the neck hole side thereof;

b) a step for moving the stitches of the other of the right front body and the left front body and the stitches of the neck hole in a direction moving away from said one of the right front body and the left front body with the formation of the widening stitches;

c) a subsequent step for knitting the other of the right front body and the left front body with substantially fixing the other of the right front body and the left front body on at least one of needle beds with respect to the left-right direction, with sequentially forming widening stitches on the neck hole side thereof with the same manner to the step a); and d) a step for moving the stitches of said one of the right front body and the left front body and the stitches of the neck hole away from the stitches of said other of the right front body and the left front body with the formation of the widening stitches.

Preferably, knitting of said steps a) and c) is made by using at least the first needle bed, and the move of said step b) is done by holding the stitches of the other of the right front body and the left front body and the stitches of the neck hole on the second needle bed, and racking the second needle in a direction moving away from said one of the right front body and the left front body by a pitch proportional to the number of widening stitches, and the move of said step d) is done by fitting the stitches of said one of the right front body and the left front body and the stitches of the neck hole on the second needle bed, and racking the second needle bed in a direction moving away from said other of the right front body and the left front body by a pitch proportional to the number of the widening stitches.

Preferably, in the above-mentioned b) and d) the widening stitches made in knitting of the front body are also moved in a direction of moving away from the front body being knitted.

In this specification widening stitch is made by hooking with an empty needle, so-called split knit or the like, and it is preferable to make a widening stitch for, for example, every knitting of a certain number of courses of the left front body or the right front body. "Substantially fixing on a needle bed with respect to the left-right direction" means that in a section of formation of widening stitch along the neck hole the left front body or the right front body being knitted is substantially prevented from moving in the longitudinal direction (left-right direction) of the needle bed. For example, in a section if the move, in the left-right direction, of the left front body or the right front body being knitted is, in terms of the number of stitches, 30% or less of the number of widening stitches, the front body is "substantially fixed" in the section. Preferably, while ten or more widening stitches are made on the neck hole side, if the left front body or the right front body being knitted is moved in the left-right direction by, in terms of the number of stitches, not more than three stitches in a section, the front body is "substantially fixed"in the section. More preferably, it is "substantially fixed" when, under the above-mentioned conditions, the move in the left-right direction of the left front body or the right front body being knitted is two stitches or less, and most preferably it is "substantially fixed" when the move is one stitch or less in the section.

Further, in a knitting method of the present invention, the knitting method on a flat knitting machine for knitting a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, comprising knitting a pair of left and right tubular bodies and a tubular body comprising front and back bodies, then, separately knitting one of the right front body and the left front body and the other of the right front body and the left front body with the neck hole being at the center, and connecting at least the front of one tubular body to said one front body, and connecting at least the front of the other tubular body to said other of the right front body and the left front body, is characterized by:

e) a step for forming widening stitches sequentially along the neck hole of said one front body and connecting at least the stitches of the front of said one tubular body to the stitches of said one of the right front body and the left front body during knitting the one of the right front body and the left front body;

f) a step for moving the neck hole and the other of the right front body and the left front body, the other tubular body, the back body, and said one tubular body toward the other side by racking the second needle bed toward said other side in parallel with said step e) with the formation of the widening stitch in said step e);

g) a subsequent step for forming widening stitches sequentially along the neck hole of the other of the right front body and the left front body, and connecting at least the stitches of the front of the other tubular body to the stitches of said other of the right front body and the left front body during knitting the other of the right front body and the left front body; and h) a step for moving the neck hole and the one of the right front body and the left front body, the one tubular body, the back body and the other tubular body toward said one side by racking the second needle bed toward said one side in parallel with said step g) and with the formation of the widening stitch in said step g). The left and right tubular bodies mean, for example, left and right sleeves or short tubular knitting around the armholes in the case of a vest.

Preferably, in the above-mentioned f) and h), widening stitches that are formed in knitting the front body are also moved in a direction of moving away from the front body being knitted.

Preferably, in said step f), the neck hole and the other of the right front body and the left front body, the other tubular body, the back body and the one tubular body are held on the second needle bed, and the needle bed is racked by a pitch proportional to the number of said widening stitches, and in said step h), the neck hole and the one of the right front body and the left front body, the one tubular body, the back body and the other tubular body are held on the second needle bed, and the needle bed is racked by a pitch proportional to the number of said widening stitches.

Preferably, in said step f), the widening stitches formed, the neck hole, the other of the right front body and the left front body, the other tubular body, the back body and the one tubular body are held on the second needle bed, and at least the other of the right front body and the left front body and the neck hole are placed over the back body and held on the second needle bed, and the needle bed is racked, and in said step h), the widening stitches formed, the neck hole, the one of the right front body and the left front body, the one tubular body, the back body, and the other tubular body are held on the second needle bed, and at least the one of the right front body and the left front body and the neck hole are placed over the back body and held on the second needle bed, and the needle bed is racked.

Further, in the invention, a knitting program on a flat knitting machine for knitting a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, is characterized by:

a) an order for knitting either front body of the right front body and the left front body by substantially fixing the front body on a needle bed with respect to the left-right direction during sequentially formation of the widening stitches along the neck hole thereof after knitting the front body up to a point of forming the neck hole;

b) an order for moving the stitches of the other of the right front body and the left front body of the right front body and the left front body and the stitches of the neck hole in a direction moving away from said one of the right front body and the left front body with the formation of the widening stitches;

c) a subsequent order for knitting said other of the right front body and the left front body by substantially fixing said other of the right front body and the left front body on a needle bed with respect to the left-right direction during sequentially formation of the widening stitches along the neck hole thereof; and d) an order for moving the stitches of said one of the right front body and the left front body and the stitches of the neck hole away from the stitches of said other of the right front body and the left front body with the formation of the widening stitches.

Preferably, in the above-mentioned b) and d), widening stitches that are formed in knitting the front body are also moved in a direction of moving away from the front body being knitted.

Preferably, in the orders of said steps a) and c), said knitting is made by using at least the first needle bed, in the order of said step b), said move is made by holding the stitches of the other of the right front body and the left front body and the stitches of the neck hole on the second needle bed and by racking the needle bed in a direction moving away from said one of the right front body and the left front body by a pitch proportional to the number of the widening stitches, and in the order of said step d), said move is made by holding the stitches of said one of the right front body and the left front body and the stitches of the neck hole on the second needle bed and by racking the needle bed in a direction moving away from said other of the right front body and the left front body by a pitch proportional to the number of the widening stitches.

Further, in a program of the invention, the knitting program on a flat knitting machine for knitting a garment connecting a pair of left and right tubular bodies a body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, is characterized by:

e) an order for sequentially forming widening stitches along the neck hole of said one of the right front body and the left front body and connecting at least the stitches of the front of one tubular body to the stitches of said one of the right front body and the left front body during knitting one of the right front body and the left front body;

f) an order for moving the neck hole, the other of the right front body and the left front body, the other tubular body, the back body, and the one tubular body toward said other side by racking the second needle bed toward said other side in parallel with said step e) and with the formation of the widening stitches in said step e);

g) an subsequent order for sequentially forming widening stitches along the neck hole of the other of the right front body and the left front body and connecting at least the stitches of the front of the other tubular body to the stitches of said other of the right front body and the left front body during knitting the other of the right front body and the left front body; and h) an order for moving the neck hole, the one of the right front body and the left front body, the one tubular body, the back body, and the other tubular body toward said one side by racking the second needle bed toward said one side in parallel with said step g) and with the formation of the widening stitches in said step g).

Preferably, in the above-mentioned f) and h), the widening stitches formed in knitting the front body are also moved in a direction of moving away from the front body being knitted.

Preferably, in said step f), the neck hole, the other of the right front body and the left front body, the other tubular body, the back body, and the one tubular body are held on the second needle bed, and the needle bed is racked by a pitch proportional to the number of said widening pitches, and in said step h), the neck hole, the one of the right front body and the left front body, the one tubular body, the back body, and the other tubular body are held on the second needle bed, and the needle bed is racked by a pitch proportional to the number of said widening stitches.

Preferably, in particular, in said step f), the widening stitches formed, the neck hole, the other of the right front body and the left front body, the other tubular body, the back body, and the one tubular body are held on the second needle bed, and at least the other of the right front body and the left front body and the neck hole are placed over the back body and held on the second needle bed, and the needle bed is racked, and in said step h), the widening stitches formed, the neck hole, the one of the right front body and the left front body, the one tubular body, the back body, and the other tubular body are held on the second needle bed, and at least the one of the right front body and the left front body and the neck hole are placed over the back body and held on the second needle bed, and the needle bed is racked.

According to the present invention, in knitting either one of the left and right front bodies on the left or right of the neck hole while forming widening stitches, the neck hole and the other front body are moved in a direction of moving away from the one front body being knitted. As a result, the widening stitches can be fitted between the neck hole and the one front body. The one front body being knitted itself is substantially fixed on a needle bed when it is knitted while making widening stitches and basically there is no need of moving the one front body to the left or right. Hence the wales of the one front body being knitted extend substantially perpendicular to the take down roller or the like. As an appropriate take down force is applied to the stitches of the one front body being knitted, knitting can be done easily. This, however, does not exclude moving the one front body being knitted slightly to the left or right, for example, by a number of stitches that is 30% or less of the number of the widening stitches. After the one front body is knitted, the other front body is knitted similarly, and this time, the other front body is knitted while the neck hole, the widening stitches formed in knitting the one front body, and the one front body are moved in a direction of moving away from the other front body. When the knitting conditions are improved, the front bodies on both sides of the neck hole can be knitted by a larger number of courses and a larger number of widening stitches can be made. Hence a deeper neck hole can be knitted to increase the value added of the garment (claims 1–10).

Preferably, one of the left and right front bodies, which is to be knitted, is knitted by using at least the first needle bed, and the move of the stitches of the front body not to be knitted and the stitches of the neck hole and the like is made by fitting these stitches on the second needle bed and racking the second needle bed, and racking is done by a pitch that is proportional to the number of the widening stitches, for example, racking is done by a pitch that is twice the number of the widening stitches (claims 2, 4, 7 and 9).

When both tubular bodies are connected to the body, the entire knitting is considered as a single tube. In the present specification the one tubular body is a tubular body such as a sleeve, which is on the side of the one front body that is knitted on the one side of the neck hole. The other tubular body is a tubular body such as a sleeve, which is on the side of the other front body. In response to widening stitch on the one front body, the front knitting except the one front body is moved toward the other side. Similarly, in response to widening stitch on the other front body, the front knitting except the other front body is moved toward the one side.

Needles for fitting widening stitches can be secured by moving the front knitting except the front body being knitted. Moreover, the stitches of the tubular body come closer to the stitches of the front body being knitted. In response to this, the stitches of the tubular body are connected to the stitches of the front body. When we pay the attention to the tubular body that is formed by the knitting as a whole, the front body being knitted is not moved, and other parts are moved to provide needles on which widening stitches are to be formed, and the tubular body and the front body being knitted are connected. With this arrangement, the front body being knitted on the outer side of the neck hole is not racked basically. Hence the knitting conditions are good, and a larger number of widening stitches can be made by knitting a large number of courses, and in turn, a deep neck hole can be made. And concurrently with this, the tubular bodies can be connected (claims 3–5 and 8–10).

The knitting can be fitted easily on the second needle bed and the needle bed can be racked, by fitting the widening stitches formed here and the front body except the front body being knitted on the second needle bed and placing the not-being knitted front body and the neck hole over the back body and fitting them on the second needle bed (claims 5, 9).

The knitting programs of the present invention can be stored in media such as disk and can be supplied to a flat knitting machine, knit design system, etc. via communication lines. The knitting programs are used in a flat knitting machine eventually, but the knitting programs may be stored in, for example, a knit design system as subroutines.

BRIEF DESCRIPTION OF THE DRAWINGS

FIG. 4 is a course diagram for knitting the neck hole of the knitting of FIG. 1 according to the embodiment.

FIG. 5 is a knitting course diagram for the neck hole in succession to FIG. 4.

EMBODIMENTS

FIG. 1 through FIG. 18 show three embodiments. A flat knitting machine to be used is one wherein a pair of front and back needle beds are provided, and for example, the back needle bed can be racked to the right and to the left in relation to the front needle bed, and stitches can be transferred between the front needle bed and the back needle bed. In the embodiments the front needle bed is defined as the first needle bed and the back needle bed as the second needle bed. Such a flat knitting machine is well known, and a flat knitting machine having two front needle beds and two back needle beds is also well known. In the latter case, the two front needle beds as a whole serve as, for example, the first needle bed, and the two back needle beds as a whole as, for example, the second needle bed. As the configurations of such flat knitting machines are well known, a description thereof is omitted. Left and right are indicated in relation to a neck bole located at the center of the front body. In principle, the side where the left front body and the left sleeve are located is called the one side, and the side where the right front body and the right sleeve are located is called the other side. In the respective embodiments the numbers of stitches in the respective parts of the knitting are illustrated smaller than the actual ones for convenience of illustration. As for the outer side and the inner side, the neck hole side is defined as the inner side, the sleeve side seen from the body is defined as the outer side, and the outer side of the knitting width seen from the sleeve is defined as the outer side.

Figure 1:
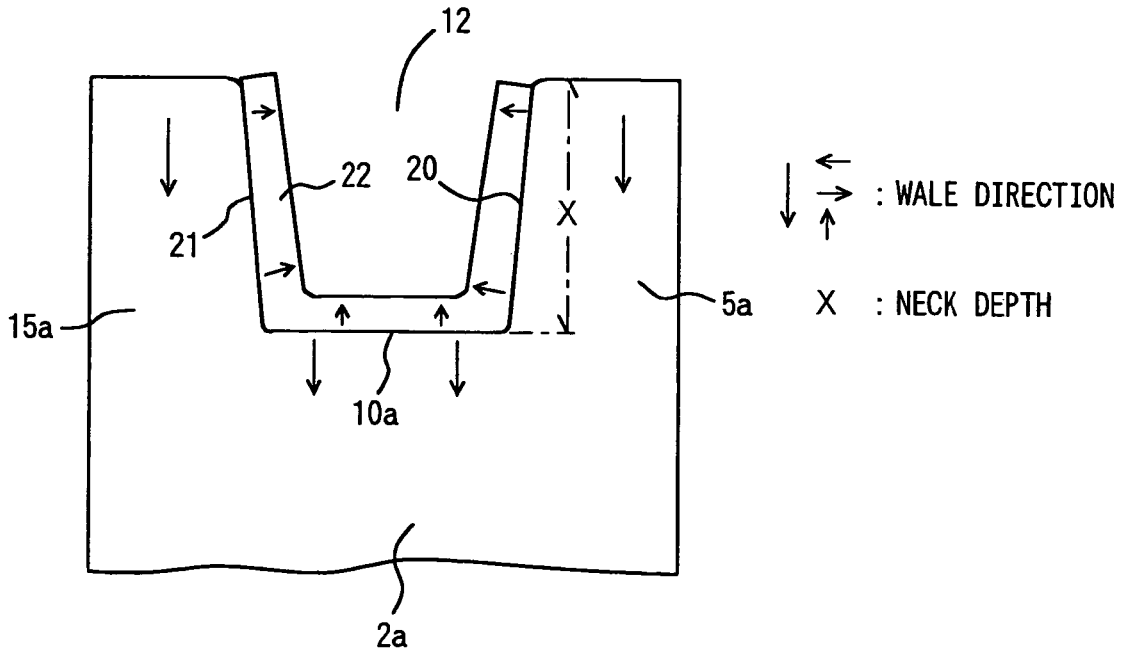
FIG. 1 is a plan view showing essential parts of knitting to be knitted in an embodiment.

FIG. 1 shows the essential portions of the knitting to be knitted in the embodiments. 2*a* denotes a front body. A left front body 5*a* and a right front body 15*a* are on both left and right sides of a lower neck hole portion 10*a*. On both left and right sides of a neck hole 12 the front body 2*a* is knitted by dividing it into the left front body 5*a* and the right front body 15*a*: during this knitting, widening stitch is made on the neck hole side by hooking with an empty needle or the like for, for example, every two courses knitted. As a result, widening stitch portions 20, 21 are generated on the left and right of the neck hole. After knitting the left front body 5*a* and the right front body 15*a*, a collar 22 is knitted around the neck hole; the wale direction of the collar 22 is perpendicular to the wale directions of the left front body 5*a* and the right front body 15*a*. X denotes a neck depth. To obtain a larger neck depth X, it is necessary to increase the numbers of widening stitches of the widening stitch portions 20, 21. The knitting of FIG. 1 itself is well known.

Figure 2:
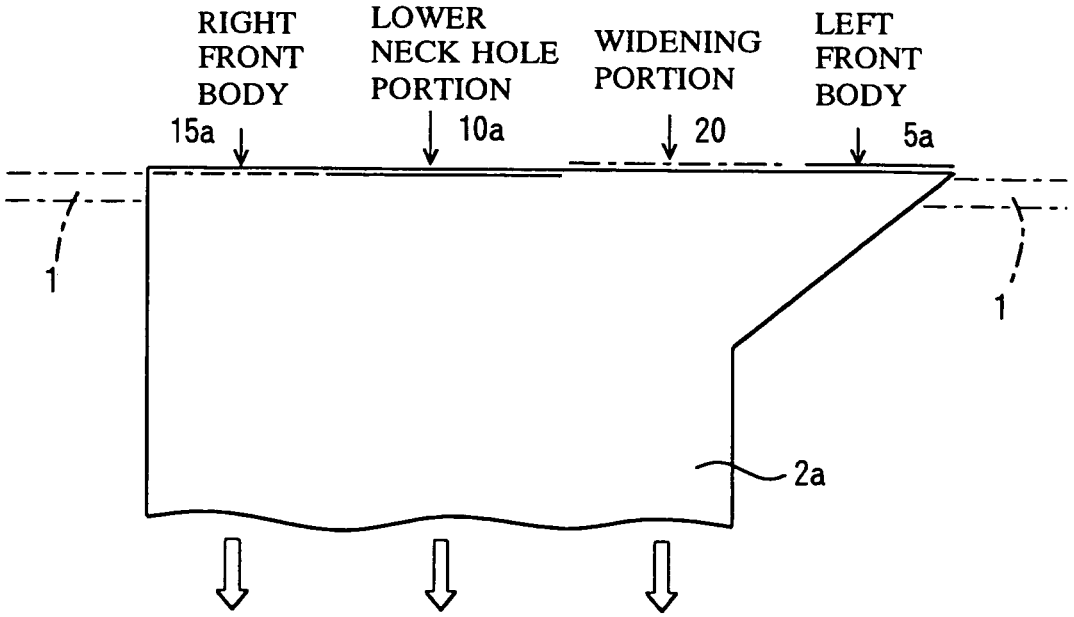
FIG. 2 is a diagram schematically showing the fitting state of knitting on needle beds when the knitting of FIG. 1 is knitted according to the conventional method.

FIG. 2 shows the fitting state of the knitting on needle beds when the knitting of FIG. 1 is knitted according to the conventional method. 1 drawn in chain line denotes the front and back needle beds, and when the left front body 5*a* is knitted, widening stitches are made in the widening stitch portion 20 and the left front body 5*a* is racked toward the right of FIG. 2 to prepare needles for fitting widening stitches between needles for fitting the lower neck hole portion 10*a* and needles for fitting the left front body 5*a*. While knitting of the left front body 5*a* is done, the stitches of the right front body 15*a*, the stitches of the lower neck hole portion 10*a* and the widening stitches already formed are just kept fitted on respective needle bed positions without any knitting, in other words, they are kept in a state of halt.

As is generally known, a take down force is applied to knitting by a take down roller or the like, which is provided in the lower part of the flat knitting machine. With this arrangement, stitches are prevented from coming off the needles, and it is important for making good knitting to apply an appropriate take down force. The take down force is applied to the lower part of the knitting and transmitted along the wales to the stitches being fitted on needles. The direction of the applied take down force is indicated by blank arrows in FIG. 2; as the left front body 5*a* being knitted has been shifted to the right and the wale direction thereof is inclined, it is difficult to apply an appropriate take down force. As an appropriate take down force can not be applied to the left front body 5*a*, the knitting conditions will be deteriorated, and in turn, the number of stitches that can be made in the widening stitch portion 20 will be limited; thus it is hard to deepen the neck depth.

Figure 3:
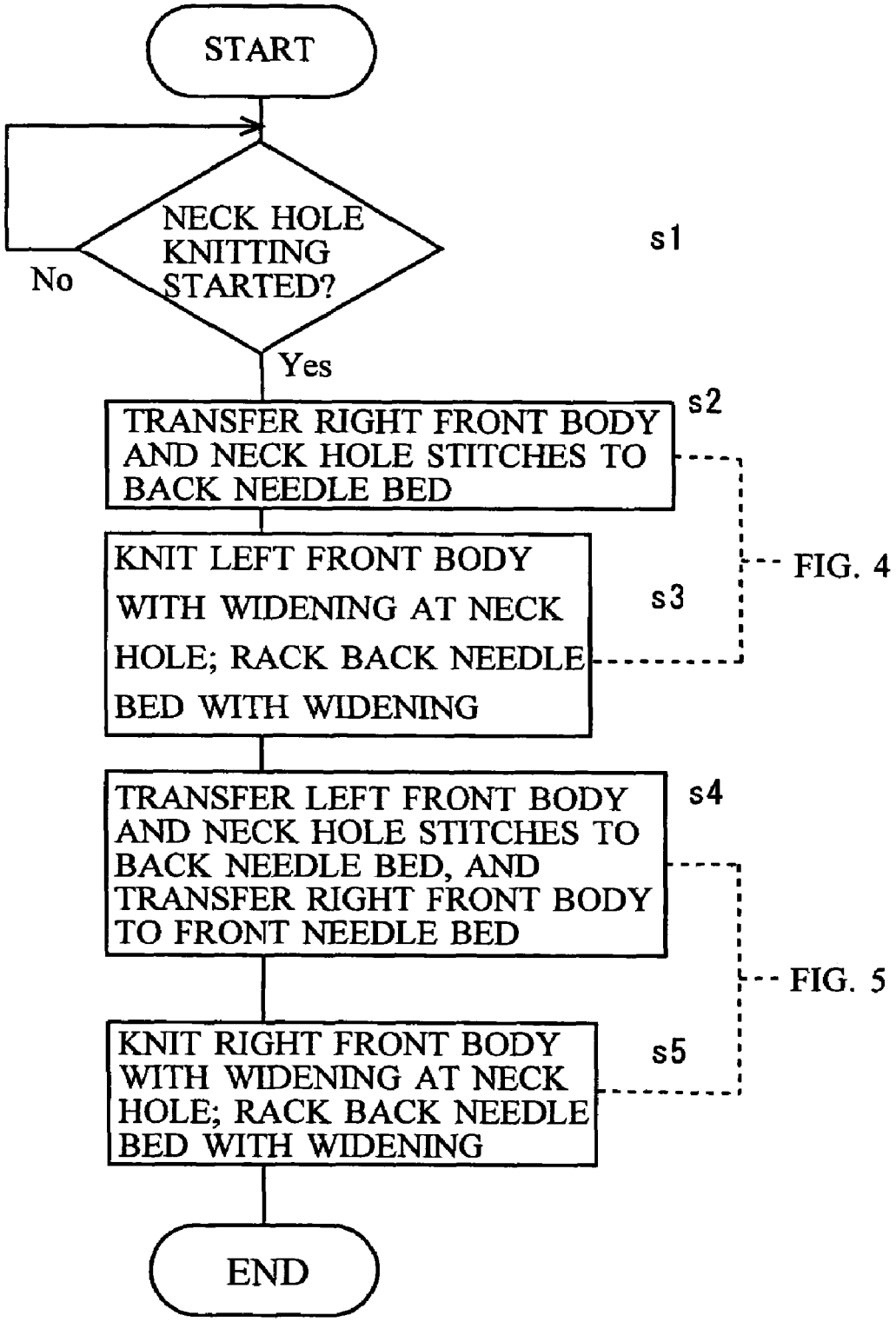
FIG. 3 is a flowchart showing a knitting program for knitting the neck hole of the knitting of FIG. 1.

FIG. 3 shows the flowchart of knitting of the neck hole according to the embodiment. The knitting program of FIG. 3 is for knitting comprising a front knitting alone, in other words, for knitting the knitting without considering the back knitting or both right and left sleeves. The front knitting is knitted in a well-known manner, and knitting of the neck hole part is started (step 1). Suppose knitting of the neck hole part is started, for example, on the left front body side. The stitches of the right front body and the stitches of the neck hole are transferred onto the back needle bed (step 2). Next, the left front body is knitted while widening stitches are made on the neck hole side, and in response to widening stitch, the back needle bed is racked to a direction opposite to the left front body, in other words, in a direction of moving away from the left front body (step 3). Next, for example, the entirety of the front knitting is transferred onto the front needle bed, then after the racking of the back needle bed is cancelled the left front body and the neck hole are transferred onto the back needle bed (step 4). After that, the right front body is knitted in a similar manner to step 3;

widening stitches are made on the neck hole side of the right front body, and in response to widening stitch, the back needle bed is racked toward the left front body side (step 5).

FIG. 4 and FIG. 5 show the major knitting courses based on the knitting program of FIG. 3. Each diagram should be read from the bottom to the top, and the numbers on the left indicate the order of the knitting courses. The arrows indicate directions of transfer. 0P indicates that no racking is made. L1P indicates that the back needle bed is racked to the left by one pitch, and L3P indicates that the back needle bed is racked to the left by three pitches. Similarly, R2P, R4P, etc. indicate that the back needle bed is racked to the right by two pitches, four pitches, etc., respectively. Moreover, knit indicates that knitting is made. These symbols are similarly used in other diagrams.

Course 1 of FIG. 4 indicates the state at the start of neck hole knitting. Squares (□) at the center indicate stitches of the neck hole, and they are kept in the state of halt in the following steps. The circles (○) on the left and right indicate stitches of the left front body and those of the right front body, respectively. In course 2 the stitches of the neck hole and the stitches of the right front body are transferred onto the back needle bed, with stitches of the left front body being left as they are. In course 3, the back needle bed is racked to the left by one pitch and the needle W of the back needle bed is emptied, then knitting is made from the needle b up to the needle W of the front needle bed, and widening stitch is made by hooking a stitch on the empty needle W of the back needle bed, then knitting is made from the needle W to the needle b of the front needle bed. In this way, With every knitting of, for example, two courses of the left front body, widening stitch is made on the neck hole side of the left front body by hooking with an empty needle, and whenever a widening stitch is made, racking by one pitch is effected toward the right front body side. As a result, up to course 6 of FIG. 4, the left front body is knitted by, for example, 8 courses, with corresponding four widening stitches. In course 7 of FIG. 4 all the stitches are transferred onto the front needle bed, and in course 9 of FIG. 5 all the stitches except those of the right front body are transferred onto the back needle bed. Subsequently, in a manner similar to that of knitting of the left front body, for example, with every knitting of two courses of the right front body, a widening stitch is made on the neck hole side of the right front body by hooking with an empty needle, and whenever a widening stitch is made, the back needle bed is racked to the right by one pitch to move it away from the right front body, and the right front body is knitted in this way up to course 13. During this time, the right front body is knitted by, for example, eight courses, four widening stitches are formed on the neck hole side of the right front body, and the back needle bed is racked to the right by four pitches. In course 14 all the stitches are transferred onto the front needle bed. As shown in course 15, four widening stitches are formed on both right and left sides of the neck hole, respectively, and knitting of the right front body and the left front body is completed. In course 15 the respective stitches, including the stitches of the lower neck hole portion and the widening stitches, are fitted on needles in the halt state. After that, a collar such as the collar 22 of FIG. 1 is knitted.

Figure 6:
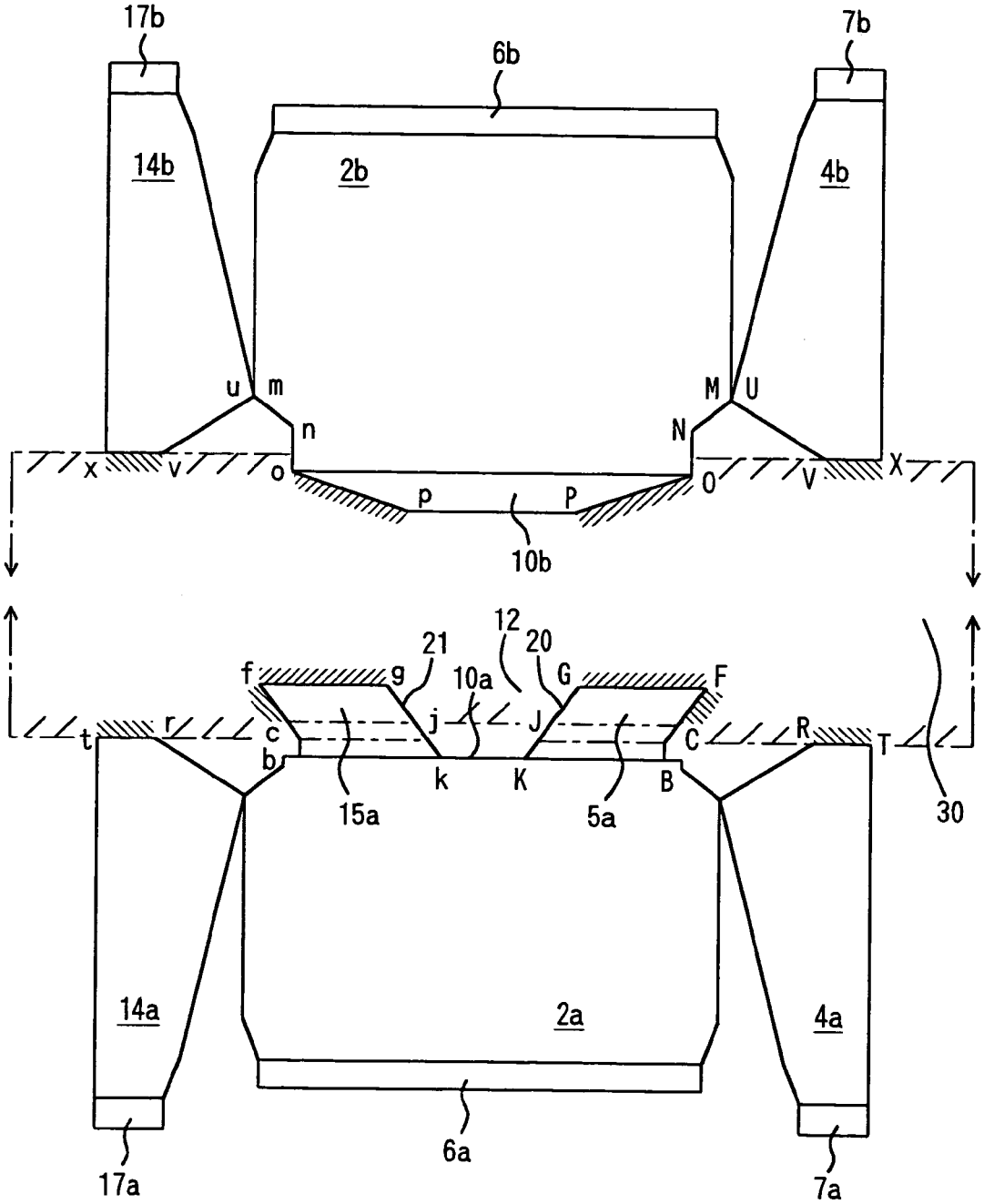
FIG. 6 is a diagram showing the pattern of knitting to be knitted in the second embodiment.

FIG. 6 through FIG. 11 show an embodiment wherein a front knitting and a back knitting are knitted as a single tubular body, a left sleeve and a right sleeve are knitted as independent tubular bodies, and they are connected seamlessly into a single garment. In FIG. 6, 2*a* denotes a front body, 2*b* is a back body, 10*a* is a lower neck hole portion, 5*a* is a left front body, 15*a* is a right front body, 10*b* is a back shoulder, and 12 is a neck hole. 6*a* and 6*b* are a front rib and a back rib, 4*a* is a left front sleeve, 4*b* is a left back sleeve, 14*a* is a right front sleeve, and 14*b* is a right back sleeve. 7*a* and 17*a* are front sleeve openings and 7*b* and 17*b* are back sleeve openings. The front body 2*a* and the back body 2*b* are knitted as a single tube, the left front sleeve 4*a* and the left back sleeve 4*b* are also knitted as a single tube, and the right front sleeve 14*a* and the right back sleeve 14*b* are also knitted as a single tube. The left and right sleeves and the body are joined at and beyond the points A, Q, a, q and the points M, U, m, u and knitted as a single tubular body. The line Q-R of the left front sleeve 4*a* is connected to the line A-C of the front body 2*a*, and the line q-r of the right front sleeve 14*a* is connected to the line a-c of the front body 2*a*. The line U-V of the left back sleeve 4*b* is connected to the line M-O of the back body 2*b*, and the line u-v of the right back sleeve 14*b* is connected to the line m-o of the back body 2*b*. In knitting the left front body 5*a* and the right front body 15*a* trapezoidal portions K-J-C-B and k-j-c-b are knitted by gradually narrowing the knitting width, stitches coming out of the knitting width being fitted on needles and left in the halt state. Knitting up to this stage itself is well known.

Portions relating to the embodiment are those in the knitting area 30 shown in FIG. 6. Here the lines R-T, r-t of the left and right front sleeves 4*a*, 14*a* and the lines X-V, x-v of the back sleeves 4*b*, 14*b* are connected to the line C~F of the left front body 5*a* and the line c~f of the right front body 15*a*, respectively. In this way the stitches of the front and back sleeves are connected to the left and right front bodies. The stitches of the line F-G of the left front body 5*a* are greater in number of stitches than the stitches of the line O-P of the back shoulder 10*b*. The stitches of the line F-G are connected to the stitches of the line O-P in such a way that the point F is connected to the point O. Remaining stitches in the neighborhood of the point G are transferred onto the back needle bed in the order of outer stitch first and then inner stitch with the left and the right reversed. For example, the outermost stitch (a stitch closer to the point F) of the remaining stitches is transferred onto the back needle bed and to the outer side of the needle on which the stitch of the point P is fitted, and the subsequent stitch is transferred to the outer side thereof; the innermost stitch of the point G is transferred to the outermost side. The stitches of the line f-g of the right front body 15*a* are treated similarly, and a part of the stitches (stitches starting from the point f) are connected to the stitches of the line o-p of the back shoulder 10*b*, and the remaining stitches are transferred onto the back needle bed; their right-left order is reversed and they are arranged on the outer side of the point p.

Figure 7:
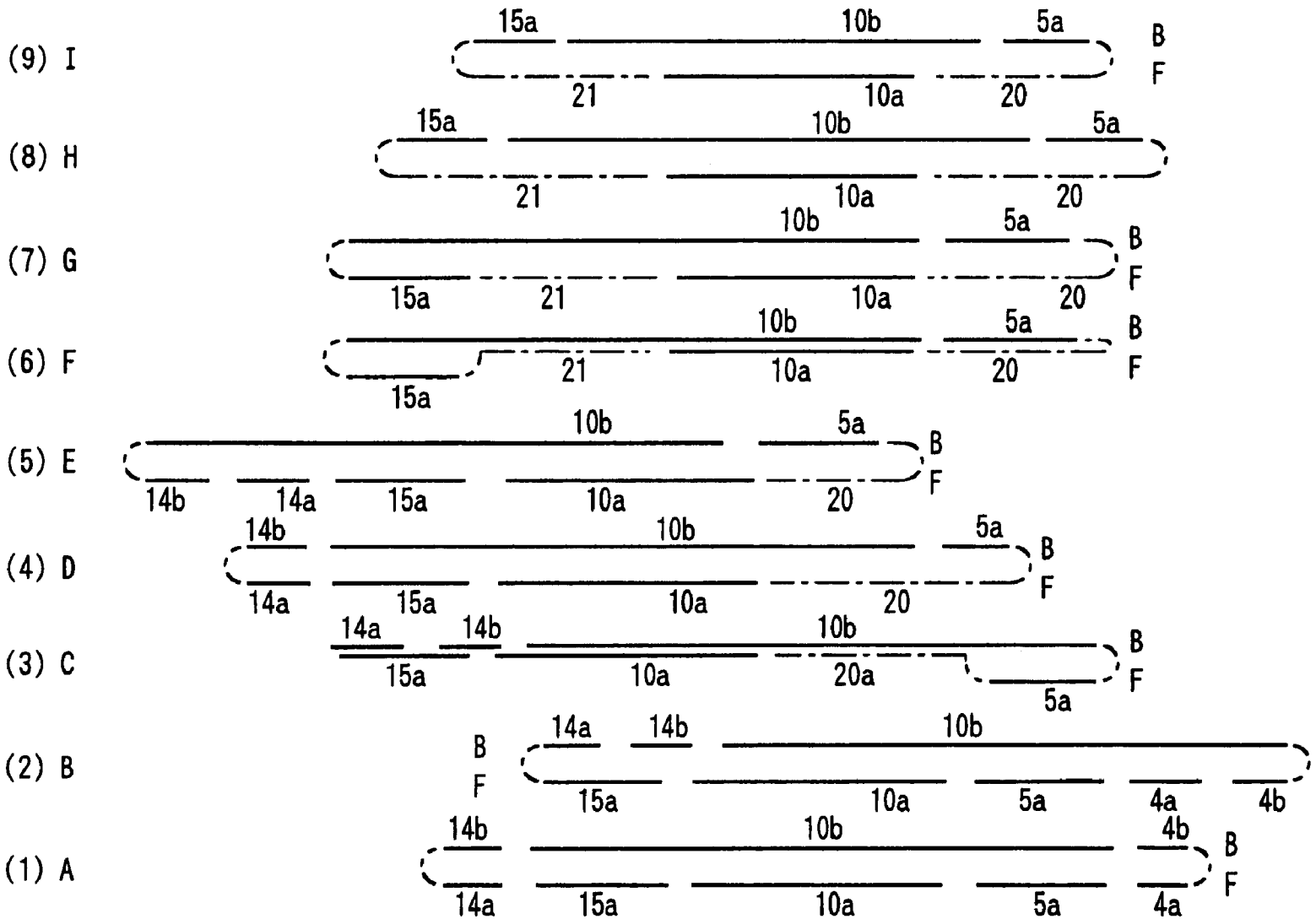
FIG. 7 is a diagram showing the outline of the knitting method for knitting the neck hole and connecting both sleeves to the body in the second embodiment.
Figure 8:
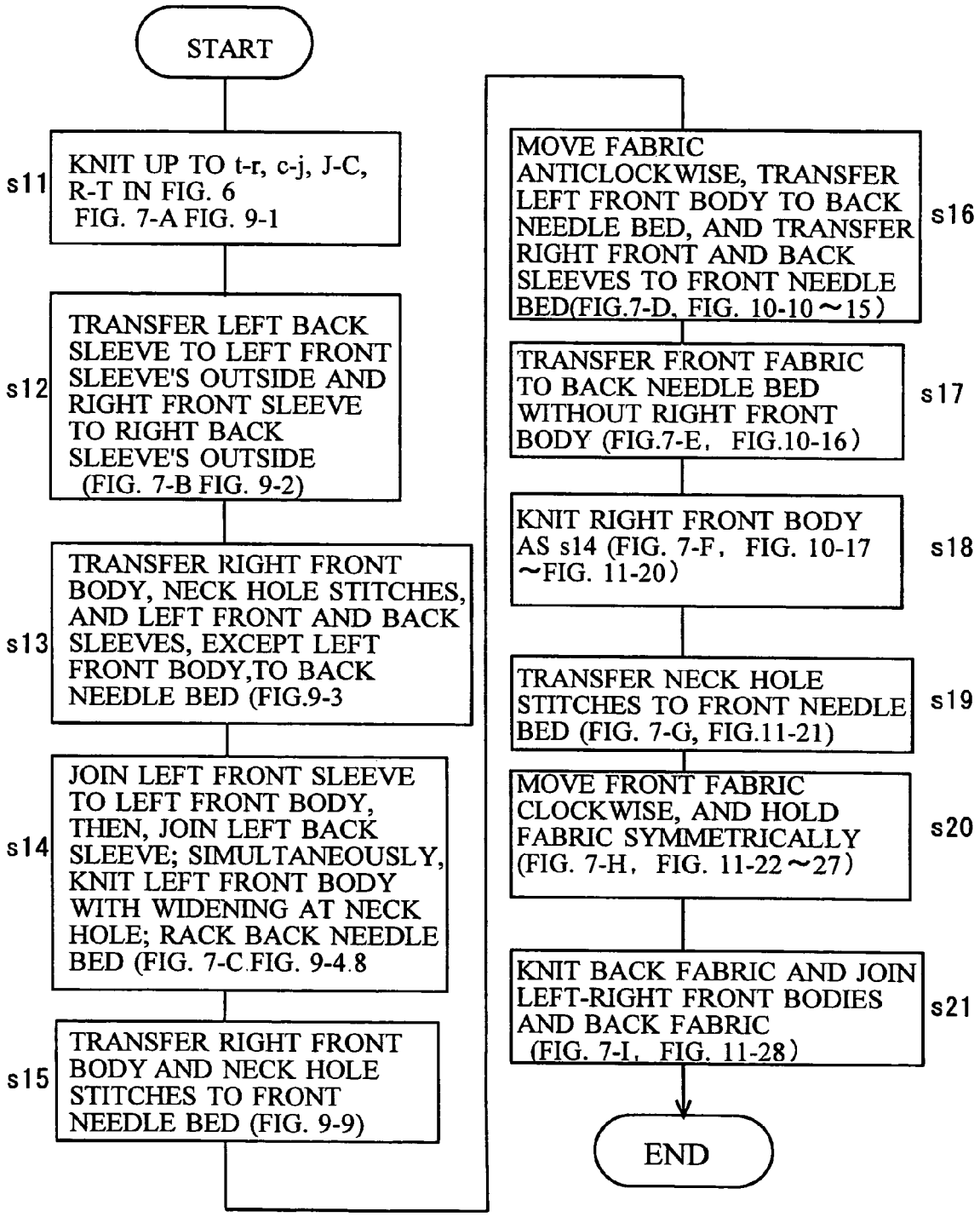
FIG. 8 is a flowchart showing a knitting program for executing the knitting method of FIG. 7.

FIG. 7 and FIG. 8 show the knitting method of the second embodiment. B in FIG. 7 indicates the back needle bed and F indicates the front needle bed. Marks 4*a*, 4*b*, etc. denote respective parts of the knitting of FIG. 6. The state of knitting just short of the knitting area 30 of FIG. 6 is shown in FIG. 7-A and step 11 of FIG. 8. At the time, the front and back bodies and both right and left sleeves, as a whole, constitute a single tubular body. From here, the left back sleeve 4*b* is transferred to the outer side of the left front sleeve 4*a*, and the right front sleeve 14*a* is transferred to the outer side of the right back sleeve 14*b* (FIG. 7-B, FIG. 8—step 12).

Next, the right front body, neck hole, left front sleeve and left back sleeve, except the left front body, are transferred onto the back needle bed (FIG. 8—step 13). Next, the left sleeve, in the order of the left front sleeve and the left back sleeve, is connected to the left front body, at the same time, a widening stitch is made on the neck hole side of the left front body for, for example, every knitting of two courses of the left front body, and in response to this, the back needle bed is racked toward the right front body side. The pitch of this racking is twice the number of widening stitches (FIG. 7-C, FIG. 8—step 14). Next, the right front body and the neck hole are transferred onto the front needle bed (FIG. 8—step 15), and the knitting is circular-transferred counter-clockwise to transfer the left front body onto the back needle bed and to transfer the right front and back sleeves onto the front needle bed (FIG. 8—step 16). These are the states of FIG. 7-D and FIG. 7-E, and this processing is executed in courses 10 through 15 of FIG. 10.

Figure 10:
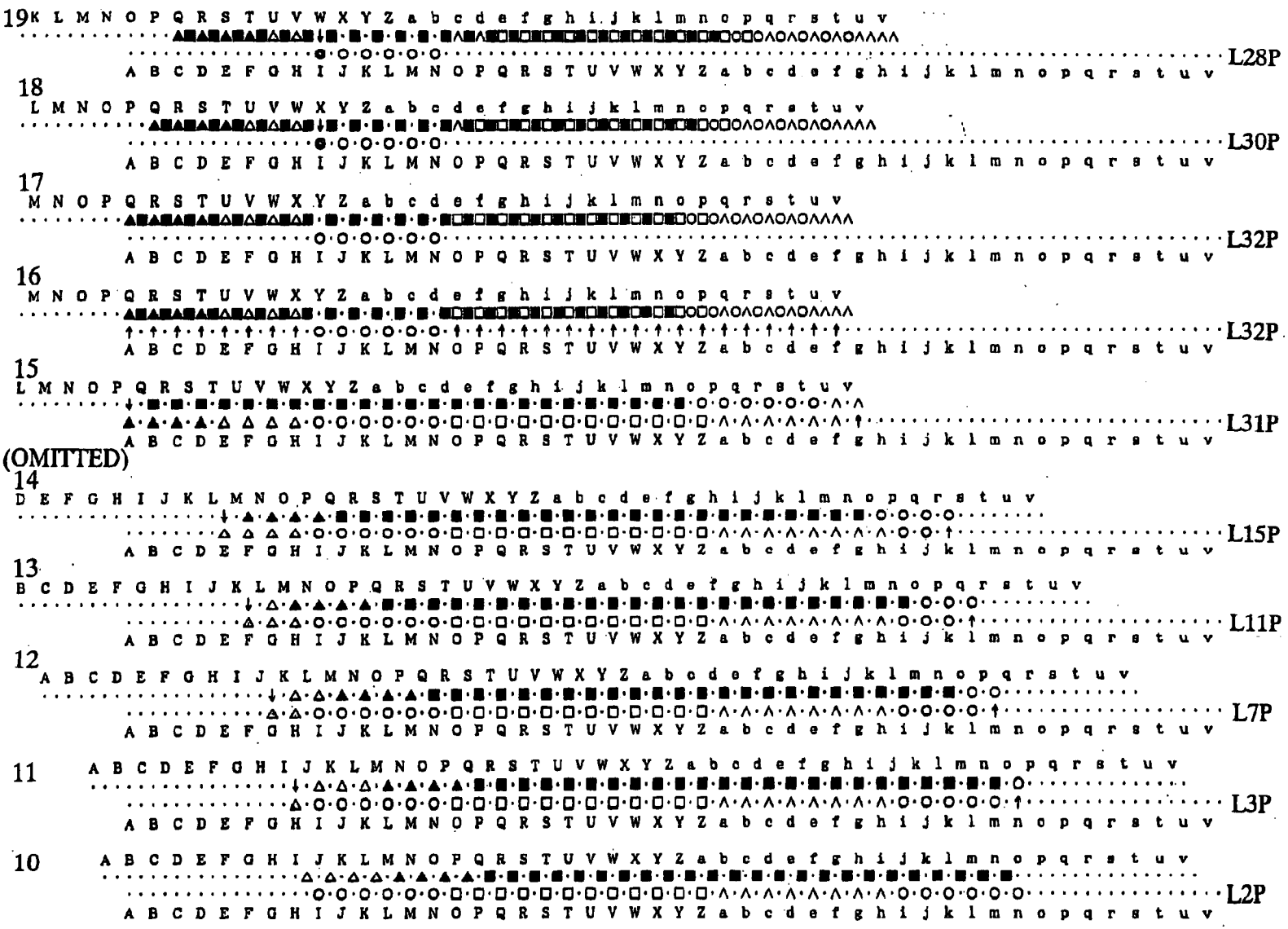
FIG. 10 is a knitting course diagram that follows FIG. 9.

In step 17 of FIG. 8 the front knitting except the right front body is transferred onto the back needle bed (FIG. 7-F, FIG. 10—course 16). Next, in step 18 of FIG. 8 the right front body is knitted just like in step 14, and during this time, the right front sleeve and the right back sleeve are connected to the right front body, and for every knitting of two courses of the right front body, for example, one widening stitch is made on the neck hole side, and in response to this, the back needle bed is racked toward the left front body side by two pitches. This state is the state of FIG. 7-F, and this knitting is executed in course 17 of FIG. 10 through course 20 of FIG. 11.

Figure 11:
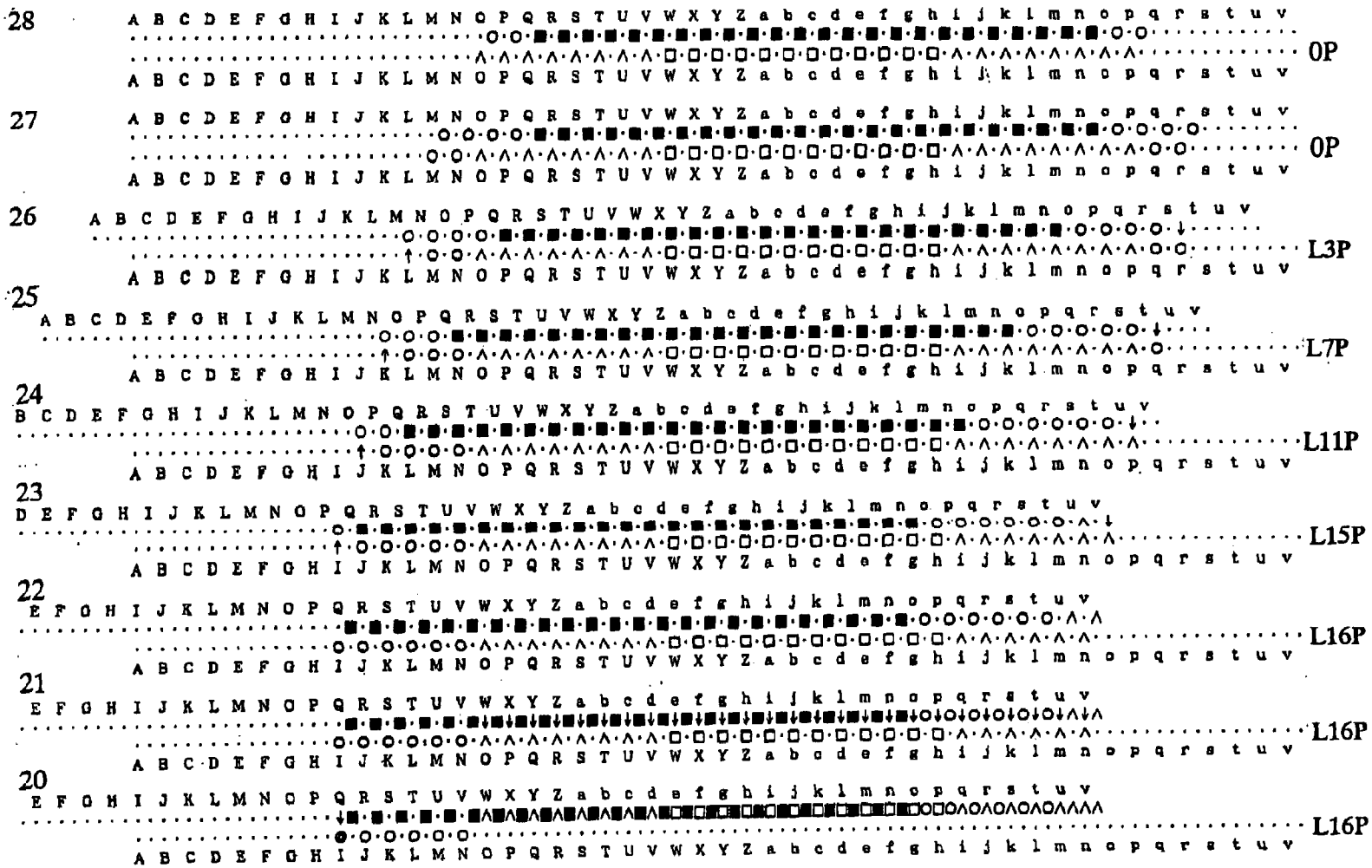
FIG. 11 is a knitting course diagram that follows FIG. 10.

After that, the neck hole is transferred onto the front needle bed (FIG. 7-G, FIG. 8—step 19), and while the back needle bed is racked toward the left front body side, the stitches of the left front body 5*a* are transferred onto the front needle bed, and a part of the stitches of the right front body 15*a* is moved to the back needle bed side to move the entirety of the front knitting and the back knitting clockwise and fit them on the front and back needle beds with the lower neck hole portion 10*a* at the center and the rest arranged symmetrically (FIG. 7H, FIG. 8—step 20, FIG. 11—courses 22 through 27). After that, the back shoulder 10*b* of the back knitting is knitted, and when the left and right front bodies 5*a*, 15*a* are connected to the back shoulder 10*b*, the knitting of FIG. 6 will be knitted (FIG. 7-I, FIG. 8—step 21, FIG. 11—course 28).

Figure 9:
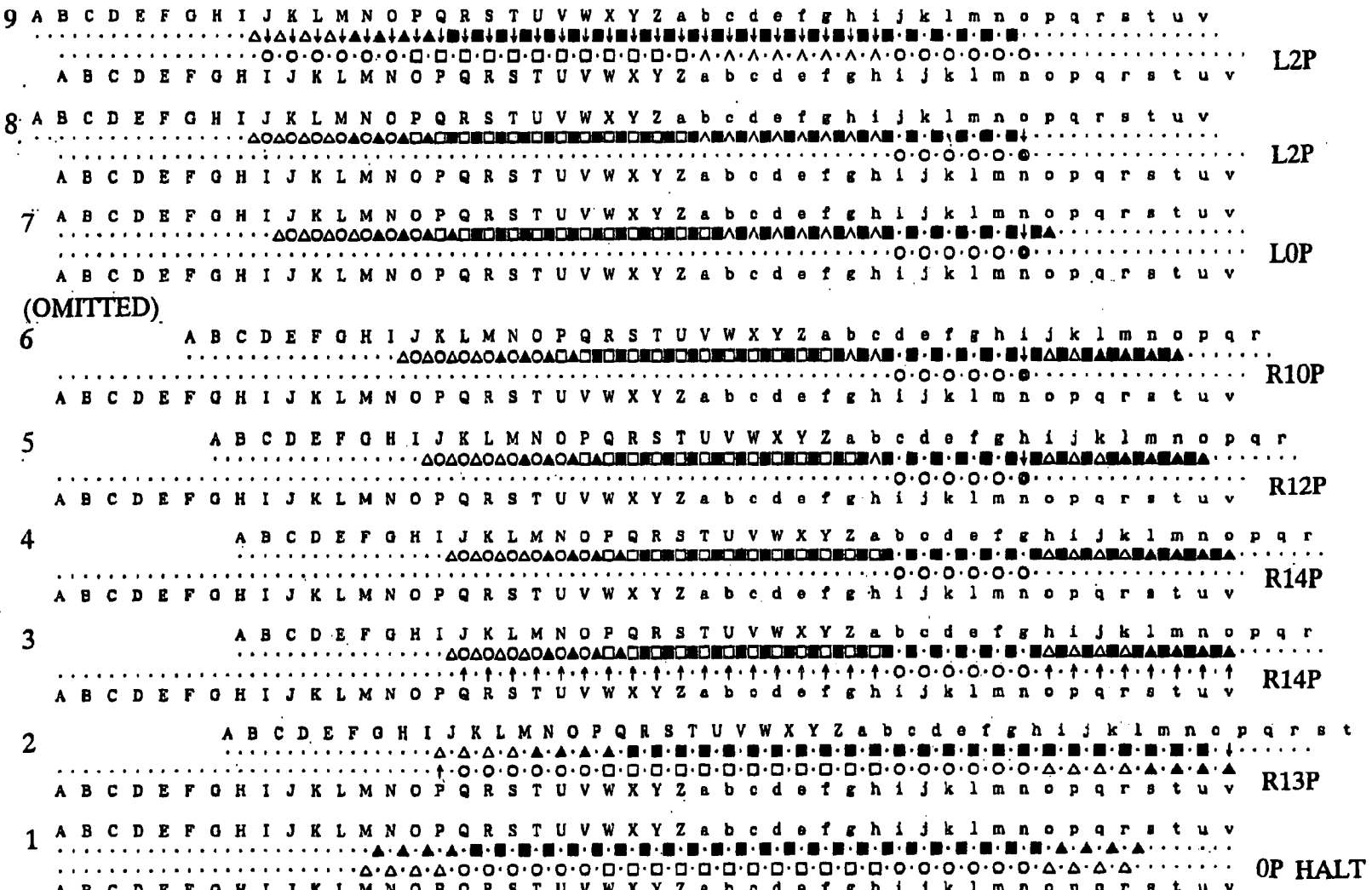
FIG. 9 is a knitting course diagram based on the knitting method of FIG. 7.

FIG. 9 through FIG. 11 show the major knitting courses of the knitting method of FIG. 7 and FIG. 8. Marking of the needles is given to every other needle. A needle with a mark is indicated by the mark, and a needle without any mark is indicated by the mark of the needle on its left side plus "-right." For example, in course 1 the rightmost stitch on the back needle bed is on the needle r-right. Course 1 of FIG. 9 shows the fitting state immediately before the start of knitting of the neck hole. During course 1 through course 2, while the back needle bed is racked to the right by 13 pitches, the left back sleeve is transferred onto the front needle bed and the right front sleeve is transferred onto the back needle bed. Transfer of sleeve is made in such a way that the order or adjacency of stitches is maintained. For example, in course 1 the stitch of the left back sleeve on the needle r-right of the back needle bed is transferred onto the needle s of the front needle bed so as to maintain its adjacency with the stitch of the left front sleeve on the needle r. Similarly, the stitch of the left back sleeve on the needle o-right is transferred onto the needle v of the front needle bed to maintain its adjacency with the outermost stitch of the back body. Similarly, in transfer of the right front sleeve, the stitch of the right front sleeve on the needle M, being adjacent to the stitch of the right back sleeve on the needle M-right, is transferred onto the needle L-right of the back needle bed, and the stitch on the needle P being adjacent to the stitch of the right front body on the needle Q is transferred in course 2 onto the needle I-right of the back needle bed. This is accomplished by transferring the left back sleeve, starting with the outermost stitch on the back needle bed, onto the front needle bed, and transferring the right front sleeve, starting with its outermost stitch on the front needle bed, onto the back needle bed.

In course 3 of FIG. 9, the back needle bed is racked toward the right side by one more pitch, and all the stitches on the front needle bed except the stitches of the left front body are transferred onto the back needle bed. Next, in course 4, the left front body is knitted by, for example, one course. In course 5, the back needle bed is racked leftward by two pitches, and a widening stitch is made by hooking on the needle b of the back needle bed, next, the left front body is knitted by one course, and the stitch of the left front sleeve (the stitch on the needle h), which is closest to the body side, is placed on the stitch of the left front body (the stitch on the needle n), which is closest to the sleeve side, to connect by one stitch.

Subsequently, in course 6 through course 8, one widening stitch is made on the neck hole side for every knitting of two courses of the left front body, and one stitch of the left sleeve is placed on one stitch of the left front body in the order of the left front sleeve and the left back sleeve, or in the order of stitches of the left front body and the stitches of the back body side, to be connected together. This is repeated to knit. During this time, whenever one widening stitch is made and connection by one stitch is made, the back needle bed is racked rightward by two pitches. As a result, in course 8 of FIG. 9 the connection between the left front sleeve and the left back sleeve is completed, and for example, eight widening stitches have been formed on the neck hole side of the left front body. Whenever a widening stitch is made, the back needle bed is racked to the left by two pitches. Hence the racking state of the back needle bed has been changed from 14 pitches to the right to 2 pitches to the left. As the stitches of the left sleeve shift toward the left front body due to racking, this is used to connect the left front sleeve to the left front body.

In course 9 of FIG. 9 the front knitting except the right front sleeve is transferred onto the front needle bed. Next, in course 10 through course 15 of FIG. 10 the stitches of the left front body are transferred onto the back needle bed in the order of the outer stitches and then the inner stitches, and the knitting of the right front sleeve is transferred onto the front needle bed in the order of the inner stitches and then the outer stitches. In course 16 stitches of the neck hole, widening stitches made on the left front body side, stitches of the right front sleeve, and stitches of the right back sleeve are transferred onto the back needle bed, but the right front body is excluded.

Next, in course 17 the right front body is knitted by, for example, one course. In course 18 the back needle bed is racked to the right by 2 pitches, and a widening stitch is made by hooking on an empty needle on the neck hole side of the right front body, then the right front body is knitted again by one course, and one stitch of the right front sleeve is connected to one stitch of the right front body. Subsequently, in a similar manner, for every knitting of two courses of the right front body, a widening stitch is made by hooking on an empty needle of the neck hole side of the right front body and one stitch of the right sleeve is connected to one stitch of the right front body. In this way, up to the course 20 of FIG. 11, knitting of the right front body and connection of the right sleeve are completed.

In course 21 stitches of the neck hole portion including widening stitches are transferred onto the front needle bed.

The state after the transfer is shown in course 22. Next, in course 23 through course 27, while the back needle bed is racked to the right, the stitches of the right front body are transferred onto the back needle bed in the order of outer stitches first and then inner stitches, and the widening stitches on the left front body side and the stitches of the left front body are transferred, in the order of inner stitches first and then outer stitches, onto the front needle bed. In this way, with the use of racking of the back needle bed and transfer, the entirety of the knitting is circular-transferred clockwise and fitted symmetrically on the front and back needle beds. Next, while the left and right front bodies and the back knitting are connected, the back shoulder portion is knitted (course 28). After that, the collar 22 shown in FIG. 1 or the like is knitted as one thinks proper.

Figure 12:
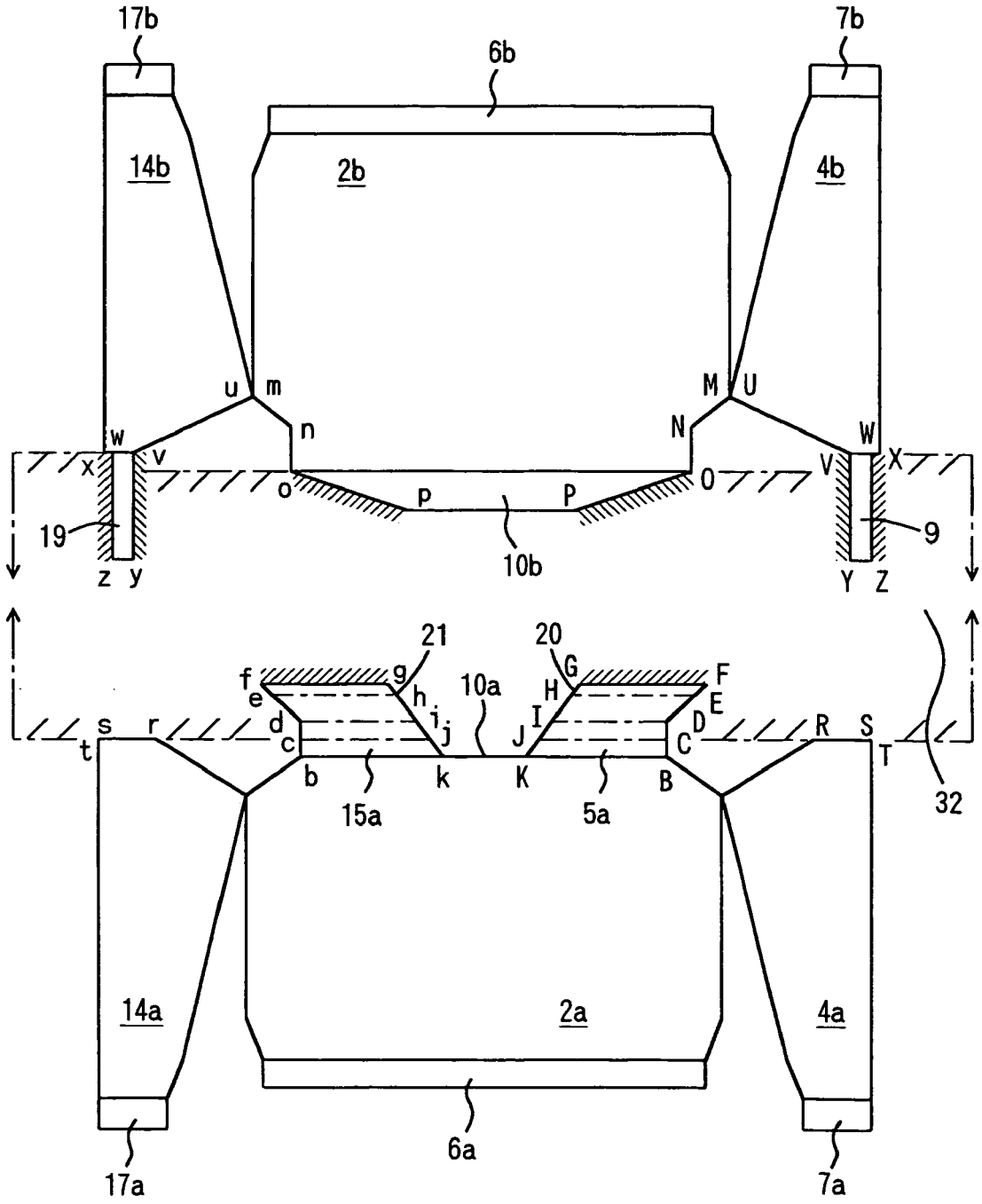
FIG. 12 is a diagram showing the pattern of knitting to be knitted in the third embodiment.
Figure 13:
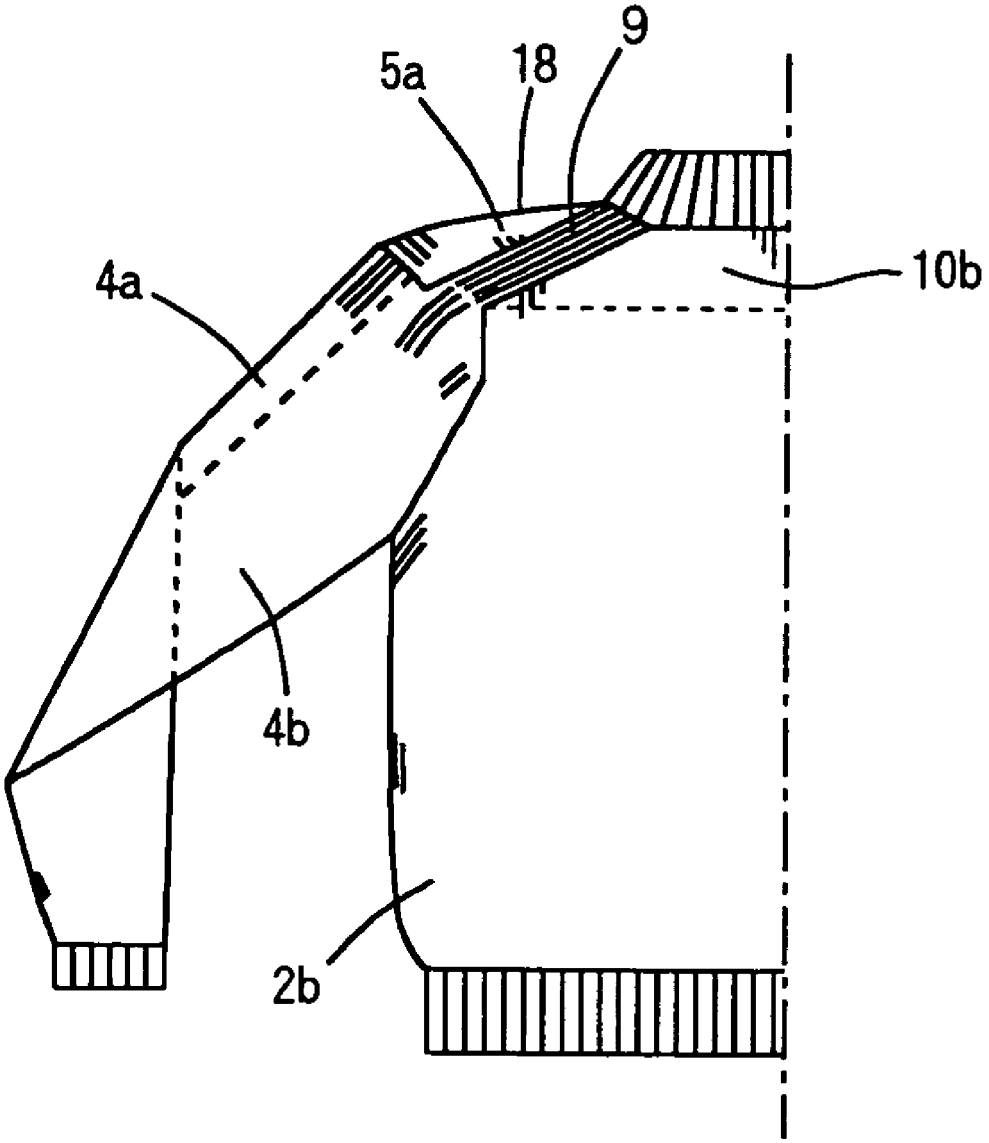
FIG. 13 is a diagram showing the back left half of the knitting to be knitted in the third embodiment.

FIG. 12 through FIG. 18 show the third embodiment. FIG. 12 shows the pattern of the knitting. It differs from the pattern of FIG. 6 in that protruding parts 9, 19 are provided on the back sleeves. As a result, the lines R-W, r-w of the left and right sleeves are connected to the lines C-F, c-f of the left and right front bodies, respectively, and the lines F-G, f-g of the left and right front bodies are connected to the lines X-Z, x-z of the protruding parts 9, 19, respectively. Moreover, the lines V-Y, v-y of the protruding parts 9, 19 are connected to the lines O-P, o-p of the back shoulder 10*b*, respectively. 32 denotes the knitting area that is done in this embodiment. With the provision of the protruding parts 9, 19, the silhouette of the garment is changed as shown, for example, in FIG. 13, and one side of the protruding part 9 is connected to the upper part of the left front body 5*a*, and the other side of the protruding part 9 is connected to the back shoulder 10*b*. This also applies similarly to the protruding part 19 on the right. 18 denotes the shoulder line.

Figure 14:
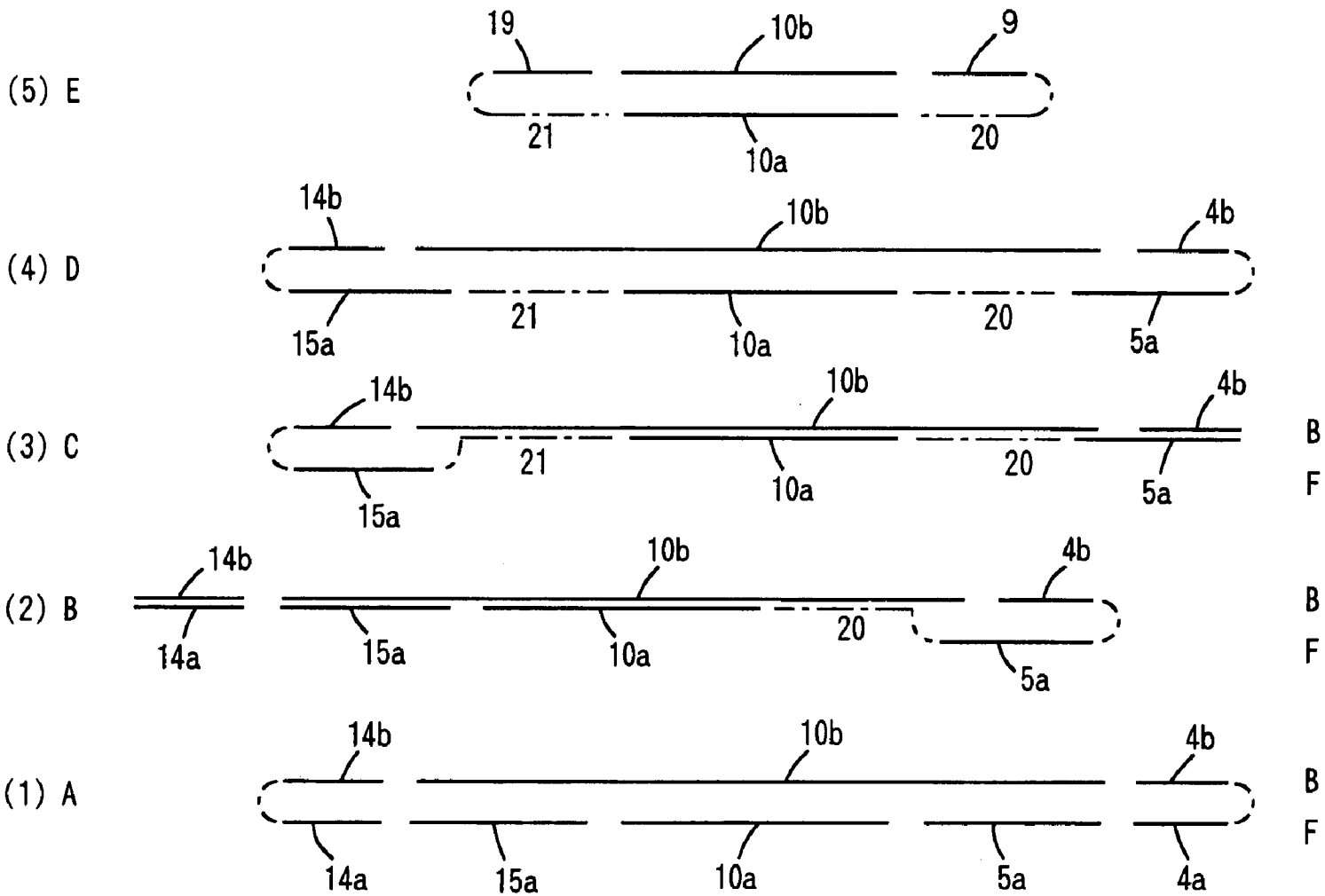
FIG. 14 is a diagram showing the outline of a knitting method for knitting the neck hole and connecting both sleeves to the body in the third embodiment.
Figure 15:
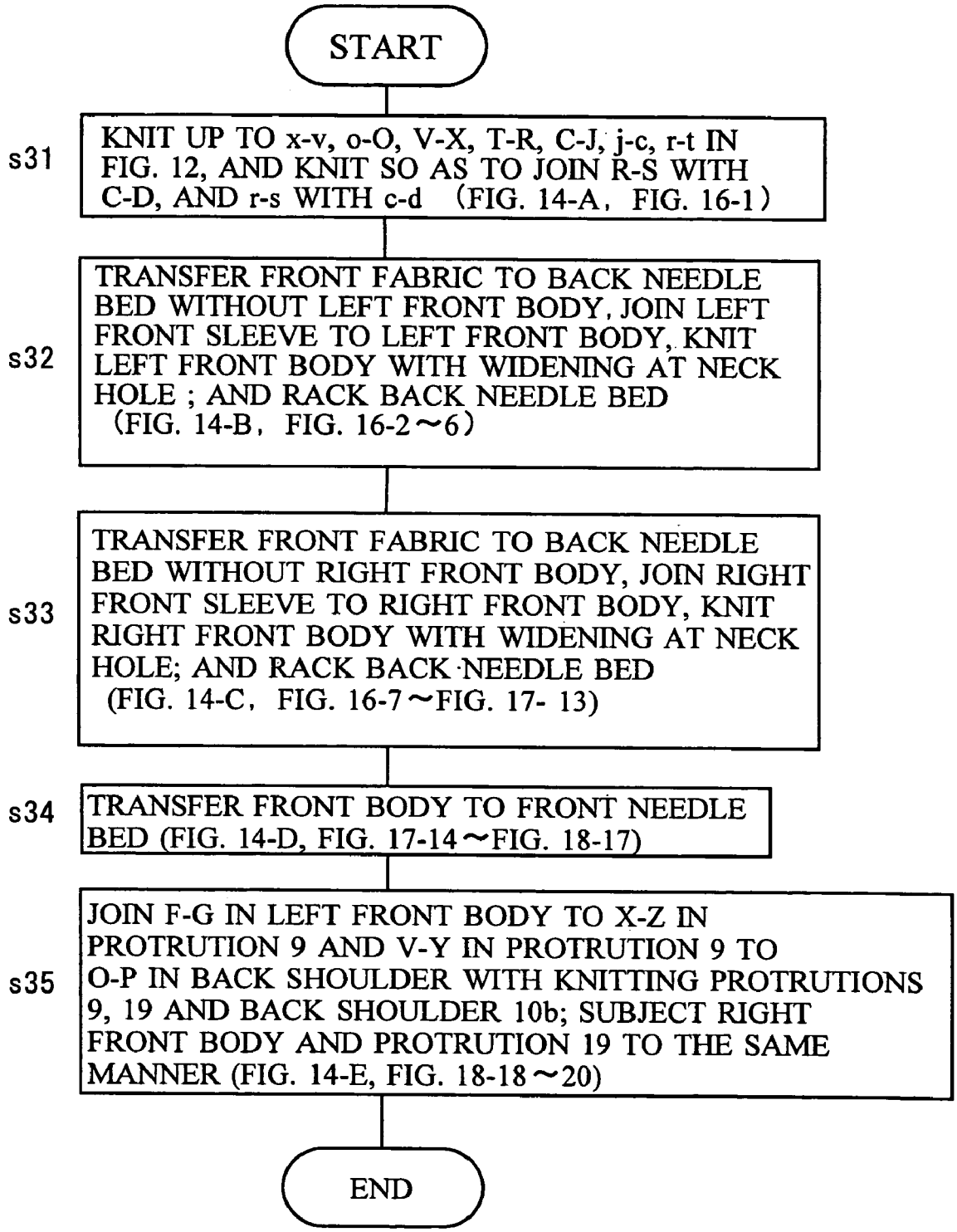
FIG. 15 is a flowchart showing a knitting program for executing the knitting method of FIG. 14.

FIGS. 14 and 15 show the knitting method of the knitting area 32. The knitting is knitted just short of the knitting area 32, then the line RS and the line C-D are connected together and the line r-s and the line c-d are connected together (FIG. 14-A, step 31 of FIG. 15, and course 1 of FIG. 16). Next, in step 32 the front knitting except the left front body is transferred onto the back needle bed. Then, of the left front sleeve, the line S-T that has not been connected yet is connected to the line D-E of the left front body, and concurrently with this, widening stitches are made on the neck hole side of the left front body, and the back needle bed is racked to the left (FIG. 14-B). In step 33 the front knitting except the right front body is transferred onto the back needle bed, and the right front sleeve is connected to the right front body. Concurrently with this, while widening stitches are made on the neck hole side of the right front body, the right front body is knitted, and the back needle bed is racked to the right (FIG. 14-C). In step 34 the front body is transferred onto the front needle bed (FIG. 14D). In step 35, while the protruding parts 9, 19 and the back shoulder 10*b* are knitted, the line F-G of the left front body is connected to the line X-Z of the protruding part 9, and the line V-Y of the protruding part 9 is connected to the line O-P of the back shoulder. The line f-g of the right front body is connected to the line x-z of the protruding part 19, and the line v-y of the protruding part 19 is connected to the line o-p of the back shoulder (FIG. 14-E).

Figure 16:
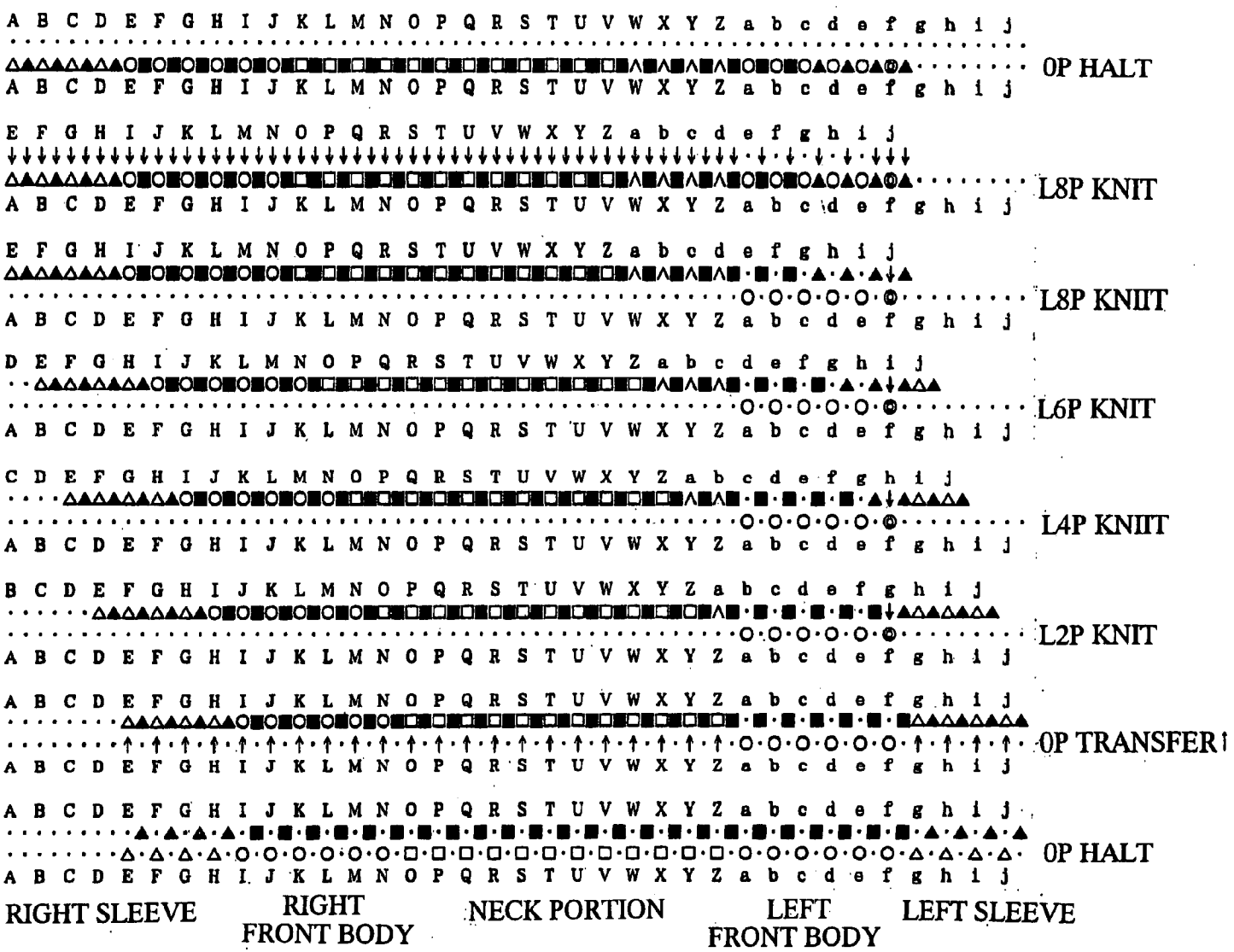
FIG. 16 is a knitting course diagram based on the knitting method of FIG. 14.
Figure 17:
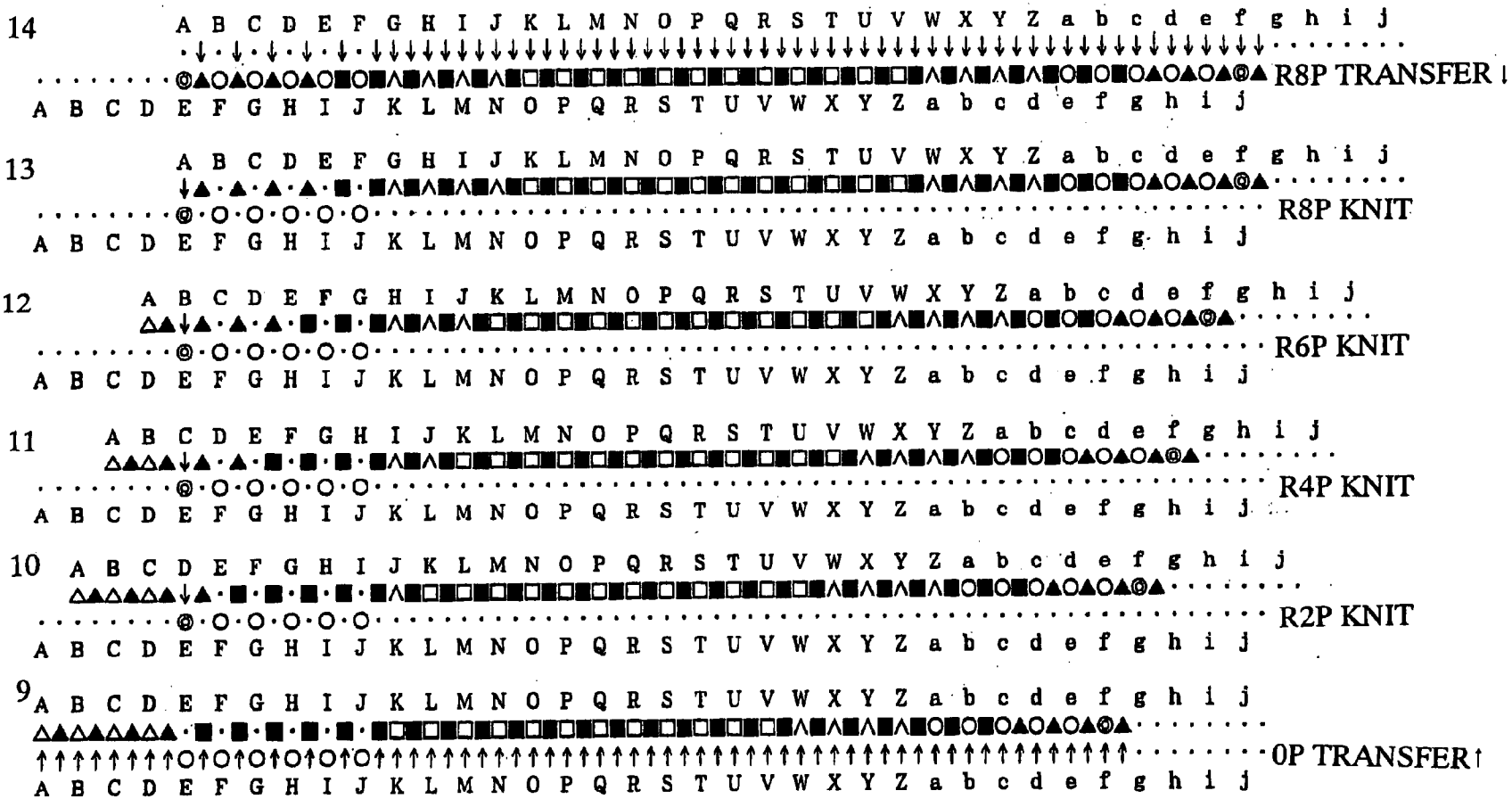
FIG. 17 is a knitting course diagram that follows FIG. 16.
Figure 18:
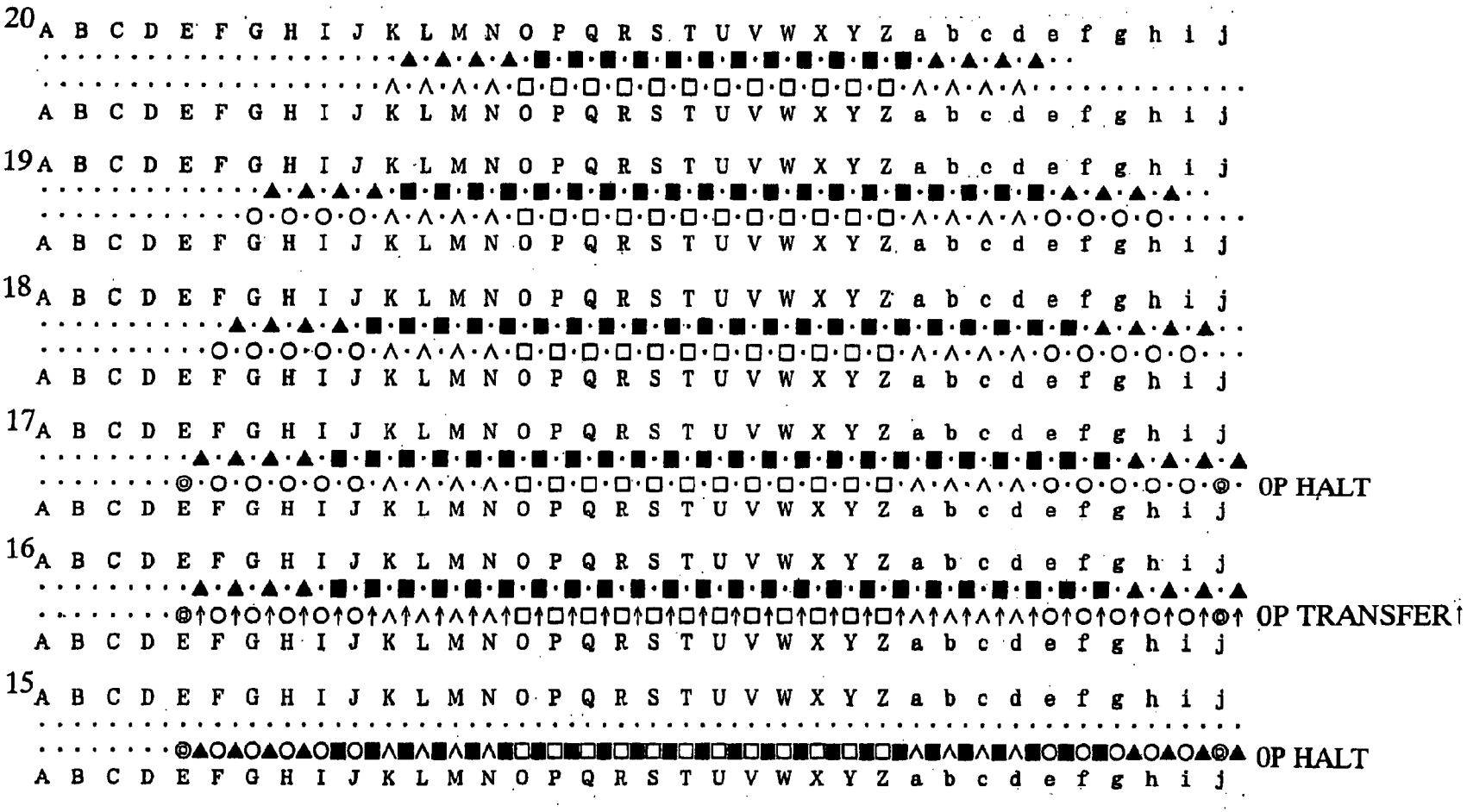
FIG. 18 is a knitting course diagram that follows FIG. 17.

FIG. 16 through FIG. 18 show the major knitting courses. Knitting starts from the state of course 1 of FIG. 16. In course 2 the front knitting except the left front body is transferred onto the back needle bed. As this transfer is transfer onto opposing needles of the back needle bed, this transfer is easier than that of the second embodiment. In course 3 and beyond, for every knitting of, for example, two courses of the left front body, one stitch of the left front sleeve is connected to the left front body, and concurrently with this, one widening stitch is made on the neck hole side of the left front body by hooking with an empty needle. Whenever one stitch is connected and one widening stitch is made, the left needle bed is racked to the left by two pitches. The state after widening stitch on the left front body is ended and connection of the left front sleeve is ended in the above-mentioned manner is shown in course 6.

In course 7 stitches are transferred so that the entire knitting is fitted on the front needle bed, and in course 8 the racking of the back needle bed is cancelled, and in course 9 the front knitting except the right front body is transferred onto the back needle bed. And in course 10 through course 14, for every knitting of, for example, two courses of the right front body, one stitch of the right front sleeve is connected to one stitch of the right front body, and one widening stitch is made on the neck hole side of the right front body by hooking with an empty needle or the like. Whenever widening stitch or connection is made, the back needle bed is racked to the right by two pitches. In course 14 the entire knitting is transferred onto the front needle bed, and the state of fitting after cancellation of the racking is shown in course 15 of FIG. 18.

In course 16 the back knitting is transferred onto the back needle bed, and the front knitting and the back knitting are separated. The state after the transfer is shown in course 17. After that, knitting of the protruding parts 9, 19 and knitting of the back shoulder 10*b* are executed, and during that time, the stitches of F-G of the left front body are connected to the stitches of X-Z of the protruding part 9, and the stitches of V-Y of the protruding part 9 are connected to the stitches of O-P of the back shoulder 10*b*. Similarly, the stitches of f-g of the right front body are connected to the stitches of x-z of the protruding part 19, and the stitches of v-y of the protruding part 19 are connected to the stitches of o-p of the back shoulder 10*b*. As a result, the stitches of the right front body and the left front body are connected and removed from the needle beds, and the knitting width of the back shoulder is reduced gradually. State of completion of knitting of the pattern of FIG. 12 is shown in course 20 of FIG. 18. Through these steps the collar is knitted circularly to join points g, h, i, j, k, K, J, I, H, G of the front body 2*a*, points Z, Y of the protruding part 9, points P, p of the back body 2*b*, and points y, z of the protruding part 19. The collar knitting is circularly knitted by a desired number of courses along the circle (line g-h-i-j-k-K-J-I-H-G-Z-Y-P-p-y-z-g) to complete knitting.

In the embodiment to keep the neck hole and the front body, sleeve, etc. not to be knitted away from the front knitting being knitted, these knitting are fitted on the back needle bed (the second needle bed) and racked. However, it is sufficient for these knitting to be fitted on the back needle bed only when they are to be racked. In other conditions they may be fitted on the front needle bed (the first needle bed). For example, stitches of the front body, neck hole, etc. of the side of not to be knitted may be transferred from the front needle bed onto the back needle bed, then the back needle bed may be racked, and after that stitches may be transferred again from the back needle bed to the front needle bed. As a result, these knitting are fitted on the front needle bed and can be moved away from the front body being knitted. Moreover, in case of rib knitting or back stitch knitting, the front body to be knitted may be knitted on the back needle bed, and when the neck hole and the other front body are to be moved away, the front body being knitted may be transferred onto the front needle bed to separate it from the neck hole and the other front body.

What is claimed is:

1. A knitting method for knitting on a flat knitting machine a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, said method comprising:

a) knitting a front body comprising a right front body and left front body up to a point at which a neck hole is to be formed, then knitting one of the right front body and the left front body, to sequentially form widening stitches on a neck hole side thereof while substantially fixing on at least one of the needle beds with respect to the left-right direction;

b) moving stitches of the other of the right front body and the left front body and the widening stitches formed on the neck hole side in a direction moving away from said one of the right front body and the left front body with the formation of the widening stitches;

c) subsequently knitting the other of the right front body and the left front body to sequentially form other widening stitches on a neck hole side thereof while substantially fixing on at least one of the needle beds with respect to the left-right direction in the same manner as step a); and d) moving the stitches of said one of the right front body and the left front body and said other widening stitches formed on the neck hole side away from the stitches of said other of the right front body and the left front body with said other formation of said other widening stitches.

2. The knitting method of claim 1, characterized in that knitting of said steps a) and c) is made by using at least the first needle bed, and the move of said step b) is done by holding the stitches of the other of the right front body and the left front body and the widening stitches formed on the neck hole side on the second needle bed, and racking the second needle bed in a direction moving away from said one of the right front body and the left front body by a pitch proportional to the number of widening stitches, and the moving of said step d) is done by fitting the stitches of said one of the right front body and the left front body and the other widening stitches formed on the neck hole side on the second needle bed, and racking the second needle bed in a direction moving away from said other of the right front body and the left front body by a pitch proportional to the number of the widening stitches.

3. The knitting method for knitting on a flat knitting machine a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, the method comprising knitting a pair of left and right tubular bodies and a tubular body comprising front and back bodies, then, separately knitting one of the right front body and the left front body and the other of the right front body and the left front body with the neck hole being at the center, and connecting at least the front of one tubular body to said one front body, and connecting at least the front of the other tubular body to said other of the right front body and the left front body, further including:

e) forming widening stitches sequentially along the neck hole of said one front body and connecting at least the stitches of the front of said one tubular body to the stitches of said one of the right front body and the left front body during knitting the one of the right front body and the left front body;

f) moving the neck hole and the other of the right front body and the left front body, the other tubular body, the back body, and said one tubular body toward the other side by racking the second needle bed toward said other side at the same time as the formation of the widening stitch in said step e);

g) subsequent the forming other widening stitches sequentially along the neck hole of the other of the right front body and the left front body, and connecting at least the stitches of the front of the other tubular body to the stitches of said other of the right front body and the left front body during knitting the other of the right front body and the left front body; and h) moving the neck hole and the one of the right front body and the left front body, the one tubular body, the back body and the other tubular body toward said one side by racking the second needle bed toward said one side at the same time as the formation of the other widening stitch in said step g).

4. The knitting method of claim 3, characterized in that in said step f), the neck hole and the other of the right front body and the left front body, the other tubular body, the back body and the one tubular body are held on the second needle bed, and the needle bed is racked by a pitch proportional to the number of said widening stitches, and in said step h), the neck hole and the one of the right front body and the left front body, the one tubular body, the back body and the other tubular body are held on the second needle bed, and the needle bed is racked by a pitch proportional to the number of said widening stitches.

5. The knitting method of claim 4, characterized in that in said step f), the widening stitches formed, the neck hole, the other of the right front body and the left front body, the other tubular body, the back body and the one tubular body are held on the second needle bed, and at least the other of the right front body and the left front body and the neck hole are placed over the back body and held on the second needle bed, and the needle bed is racked, and in said step h), the widening stitches formed, the neck hole, the one of the right front body and the left front body, the one tubular body, the back body, and the other tubular body are held on the second needle bed, and at least the one of the right front body and the left front body and the neck hole are placed over the back body and held on the second needle bed, and the needle bed is racked.

6. A knitting program on a flat knitting machine for knitting a front body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, said knitting program comprising:

a) an order for knitting either front body of the right front body and the left front body by substantially fixing the front body on a needle bed with respect to the left-right direction during sequential formation of the widening stitches along the neck hole thereof after knitting the front body up to a point of forming the neck hole;

b) an order for moving stitches of the other of the right front body and the left front body of the right front body and the left front body and the widening stitches formed on the neck hole side in a direction moving away from said one of the right front body and the left front body with the formation of the widening stitches;

c) a subsequent order for knitting said other of the right front body and the left front body by substantially fixing said other of the right front body and the left front body on a needle bed with respect to the left-right direction during sequential formation of other widening stitches formed on a neck hole side thereof; and d) an order for moving the stitches of said one of the right front body and the left front body and said other widening stitches formed on the neck hole side away from the stitches of said other of the right front body and the left front body with the formation of said other widening stitches.

7. The knitting program of claim 6, characterized in that in the orders of said steps a) and c), said knitting is made by using at least the first needle bed, in the order of said step b), said move is made by holding the stitches of the other of the right front body and the left front body and the widening stitches formed on the neck hole side on the second needle bed and by racking the needle bed in a direction moving away from said one of the right front body and the left front body by a pitch proportional to the number of the widening stitches, and in the order of said step d), said move is made by holding the stitches of said one of the right front body and the left front body and the other widening stitches formed on the neck hole side on the second needle bed and by racking the needle bed in a direction moving away from said other of the right front body and the left front body by a pitch proportional to the number of the widening stitches.

8. A knitting program on a flat knitting machine for knitting a garment connecting a pair of left and right tubular bodies a body including a neck hole, wherein the flat knitting machine is provided with at least one first needle bed and at least one second needle bed, wherein at least said second needle bed can be racked freely to the left and to the right, and wherein a stitch can be freely transferred between the first needle bed and the second needle bed, characterized by comprising:

e) an order for sequentially forming widening stitches along the neck hole of said one of the right front body and the left front body and connecting at least the stitches of the front of one tubular body to the stitches of said one of the right front body and the left front body during knitting one of the right front body and the left front body;

f) an order for moving the neck hole, the other of the right front body and the left front body, the other tubular body, the back body, and the one tubular body toward said other side by racking the second needle bed toward said other side at the same time as the formation of the widening stitches in said step e);

g) an subsequent order for sequentially forming widening stitches along the neck hole of the other of the right front body and the left front body and connecting at least the stitches of the front of the other tubular body to the stitches of said other of the right front body and the left front body during knitting the other of the right front body and the left front body; and h) an order for moving the neck hole, the one of the right front body and the left front body, the one tubular body, the back body, and the other tubular body toward said one side by racking the second needle bed toward said one side at the same time as the formation of the widening stitches in said step g).

9. The knitting program of claim 8, characterized in that in said step f), the neck hole, the other of the right front body and the left front body, the other tubular body, the back body, and the one tubular body are held on the second needle bed, and the needle bed is racked by a pitch proportional to the number of said widening pitches, and in said step h), the neck hole, the one of the right front body and the left front body, the one tubular body, the back body, and the other tubular body are held on the second needle bed, and the needle bed is racked by a pitch proportional to the number of said widening stitches.

10. The knitting program of claim 9, characterized in that in said step f), the widening stitches formed, the neck hole, the other of the right front body and the left front body, the other tubular body, the back body, and the one tubular body are held on the second needle bed, and at least the other of the right front body and the left front body and the neck hole are placed over the back body and held on the second needle bed, and the needle bed is racked, and in said step h), the widening stitches formed, the neck hole, the one of the right front body and the left front body, the one tubular body, the back body, and the other tubular body are held on the second needle bed, and at least the one of the right front body and the left front body and the neck hole are placed over the back body and held on the second needle bed, and the needle bed is racked.

* * * * *